US011504984B2

(12) United States Patent
Yazawa et al.

(10) Patent No.: US 11,504,984 B2
(45) Date of Patent: Nov. 22, 2022

(54) PRINTING APPARATUS AND CONTROL METHOD

(71) Applicant: CANON KABUSHIKI KAISHA, Tokyo (JP)

(72) Inventors: Takeshi Yazawa, Kanagawa (JP); Yuji Konno, Kanagawa (JP); Hidehiko Kanda, Kanagawa (JP); Hajime Nagai, Kanagawa (JP); Shingo Nishioka, Kanagawa (JP); Keiji Kuriyama, Saitama (JP); Kei Yoshizawa, Kanagawa (JP); Serena Yoshikawa, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/167,465

(22) Filed: Feb. 4, 2021

(65) Prior Publication Data

US 2021/0268811 A1 Sep. 2, 2021

(30) Foreign Application Priority Data

Feb. 27, 2020 (JP) ..... JP2020-031662

(51) Int. Cl.
*B41J 11/00* (2006.01)
*B41J 11/02* (2006.01)
(Continued)

(52) U.S. Cl.
CPC ..... *B41J 11/008* (2013.01); *B41J 11/0045* (2013.01); *B41J 11/02* (2013.01); *B41J 11/06* (2013.01); *B41J 13/03* (2013.01); *B41J 3/4071* (2013.01); *B41J 3/413* (2013.01); *B41J 11/009* (2013.01)

(58) Field of Classification Search
CPC ..... B41J 11/008; B41J 11/0045; B41J 11/02; B41J 3/4071; B41J 3/413; B41J 11/009; B41J 11/06; B41J 13/03
See application file for complete search history.

(56) References Cited

U.S. PATENT DOCUMENTS 8,811,883 B2 8/2014 Miyauchi
2007/0058187 A1 3/2007 Miyauchi
(Continued)

FOREIGN PATENT DOCUMENTS

JP 2007-069576 A 3/2007

*Primary Examiner* — Henok D Legesse
(74) *Attorney, Agent, or Firm* — Venable LLP

(57) ABSTRACT

A printing apparatus provides a conveyance operation in which a conveyance unit conveys a print medium in a conveyance direction, and includes a control unit to control a printing unit such that, in a case where an image is to be printed onto a print medium of a first type in a first state in which the print medium of the first type is supported by a first conveyance member and not supported by a second conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

27 Claims, 23 Drawing Sheets

(51) Int. Cl.

| | |
|---|---|
| ***B41J 11/06*** | (2006.01) |
| ***B41J 13/03*** | (2006.01) |
| *B41J 3/407* | (2006.01) |
| *B41J 3/413* | (2006.01) |

(56) References Cited

U.S. PATENT DOCUMENTS

| | | | | |
|---|---|---|---|---|
| 2008/0266348 | A1* | 10/2008 | Seki | B41J 29/393 347/19 |
| 2013/0106957 | A1* | 5/2013 | Kinas | B41J 11/06 347/54 |
| 2014/0132657 | A1* | 5/2014 | Hayashi | B41J 2/2135 347/12 |

* cited by examiner

PRINTING APPARATUS AND CONTROL METHOD

BACKGROUND OF THE INVENTION

Field of the Invention

The present invention relates to a printing apparatus capable of printing an image onto a print medium with relatively high stiffness, and a method of controlling the printing apparatus.

Description of the Related Art

Some printing apparatuses in recent years are capable of printing not only media with relatively low stiffness such as plain paper, photo paper, and art paper but also media with relatively high stiffness such as discs, card paper, and board paper.

Japanese Patent Laid-Open No. 2007-69576 discloses flat-pass conveyance in which a path for conveyance from sheet feed through sheet discharge is made substantially flat in order to smoothly perform the series of processes of sheet feed, printing, and sheet discharge even with a high-stiffness print medium without exerting an undue drag on the print medium.

Generally, in a printing unit of a printing apparatus, a print medium is conveyed by a conveyance roller and a sheet discharge roller, and an image is printed onto the print medium by a print head disposed between the conveyance roller and the sheet discharge roller.

With a high-stiffness print medium, however, there is a case where the print medium is inclined by its own weight in a state where it is out of contact with one of the conveyance roller and the sheet discharge roller and the distance between the print head and the print medium being printed (head-to-medium distance) cannot be kept constant. Thus, even by employing the flat-pass conveyance disclosed in Japanese Patent Laid-Open No. 2007-69576, the head-to-medium distance may change during printing of a leading edge portion or a trailing edge portion of the print medium, which may result in failure to obtain a high-quality image.

SUMMARY OF THE INVENTION

The present invention has been made to solve the above problem. It is therefore an object of the present invention to provide a printing apparatus capable of printing a high-quality image onto a leading edge portion or a trailing edge portion of a high-stiffness print medium, and a method of controlling the printing apparatus.

In a first aspect of the present invention, there is provided a printing apparatus comprising: a conveyance unit including a first conveyance member that conveys a print medium in a conveyance direction and a second conveyance member that is disposed downstream of the first conveyance member in the conveyance direction and conveys the print medium in the conveyance direction; a printing unit located between the first conveyance member and the second conveyance member in the conveyance direction and having a printing element array being a plurality of printing elements that are arrayed in the conveyance direction and apply a print material onto the print medium conveyed by the conveyance unit; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a first state in which the print medium of the first type is supported by the first conveyance member and not supported by the second conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

In a second aspect of the present invention, there is provided a printing apparatus comprising: a conveyance unit including a first conveyance member that conveys a print medium in a conveyance direction and a second conveyance member that is disposed downstream of the first conveyance member in the conveyance direction and conveys the print medium in the conveyance direction; a printing unit located between the first conveyance member and the second conveyance member in the conveyance direction and having a printing element array being a plurality of printing elements that are arrayed in the conveyance direction and apply a print material onto the print medium conveyed by the conveyance unit; an obtaining unit that obtains information indicating a type of the print medium; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where the information obtained by the obtaining unit indicates board paper and an image is to be printed onto the print medium in a state where the print medium is supported by the first conveyance member and not supported by the second conveyance member, the printing unit uses a printing element included in a first region and does not use a printing element included in a second region located downstream of the first region in the conveyance direction.

In a third aspect of the present invention, there is provided a printing apparatus comprising: a conveyance unit including a first conveyance member that conveys a print medium in a conveyance direction and a second conveyance member that is disposed downstream of the first conveyance member in the conveyance direction and conveys the print medium in the conveyance direction; a printing unit located between the first conveyance member and the second conveyance member in the conveyance direction and having a printing element array being a plurality of printing elements that are arrayed in the conveyance direction and apply a print material onto the print medium conveyed by the conveyance unit; a platen disposed between the first conveyance member and the second conveyance member in the conveyance direction at a position lower than the first conveyance member in a height direction perpendicular to a surface where the printing elements are arrayed, and supporting the print medium from below; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a state in which the print medium of the first type is supported by the first conveyance member and not supported by the second conveyance member, the printing unit uses a printing element included in a first region and does not use a printing element included in a second region located downstream of the first region in the conveyance direction.

In a fourth aspect of the present invention, there is provided a printing apparatus comprising: a conveyance unit including a first conveyance member that conveys a print medium in a conveyance direction and a second conveyance member that is disposed downstream of the first conveyance member in the conveyance direction and conveys the print medium in the conveyance direction; a printing unit located between the first conveyance member and the second conveyance member in the conveyance direction and having a printing element array being a plurality of printing elements that are arrayed in the conveyance direction and apply a print material onto the print medium conveyed by the conveyance unit; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a state in which the print medium of the first type is supported by the second conveyance member and not supported by the first conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

In a fifth aspect of the present invention, there is provided a control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a first state in which the print medium of the first type is supported by the first conveyance member and not supported by the second conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

In a sixth aspect of the present invention, there is provided a control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, a printing unit located between the first conveyance member and the second conveyance member in the conveyance direction and having a printing element array being a plurality of printing elements that are arrayed in the conveyance direction and apply a print material onto the print medium conveyed by the conveyance unit, and an obtaining unit that obtains information indicating a type of the print medium to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where the information obtained by the obtaining unit indicates board paper and an image is to be printed onto the print medium in a state where the print medium is supported by the first conveyance member and not supported by the second conveyance member, the printing unit uses a printing element included in a first region and does not use a printing element included in a second region located downstream of the first region in the conveyance direction.

In a seventh aspect of the present invention, there is provided a control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, a platen disposed between the first conveyance member and the second conveyance member in the conveyance direction at a position lower than the first conveyance member in a height direction, and supporting the print medium from below, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a state in which the print medium of the first type is supported by the first conveyance member and not supported by the second conveyance member, the printing unit uses a printing element included in a first region and does not use a printing element included in a second region located downstream of the first region in the conveyance direction.

In an eighth aspect of the present invention, there is provided a control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a state in which the print medium of the first type is supported by the second conveyance member and not supported by the first conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

Further features of the present invention will become apparent from the following description of exemplary embodiments with reference to the attached drawings.

DESCRIPTION OF THE EMBODIMENTS

First Embodiment

An embodiment of the present invention will be described below in detail with reference to drawings.

1. Basic Configuration 1.1 Configurations of Mechanism Sections

Configurations of mechanism sections in an inkjet printing apparatus J1 (hereinafter also referred to simply as the printing apparatus J1) employed in the present embodiment will be described. In the following, in drawings, an X direction represents the direction of movement of a later-described carriage M4000, a Y direction represents the direction of conveyance of a print medium, and a Z direction represents the direction perpendicular to the ejection opening surface of a print head.

(A) Outer Case Unit

Figure 1A:
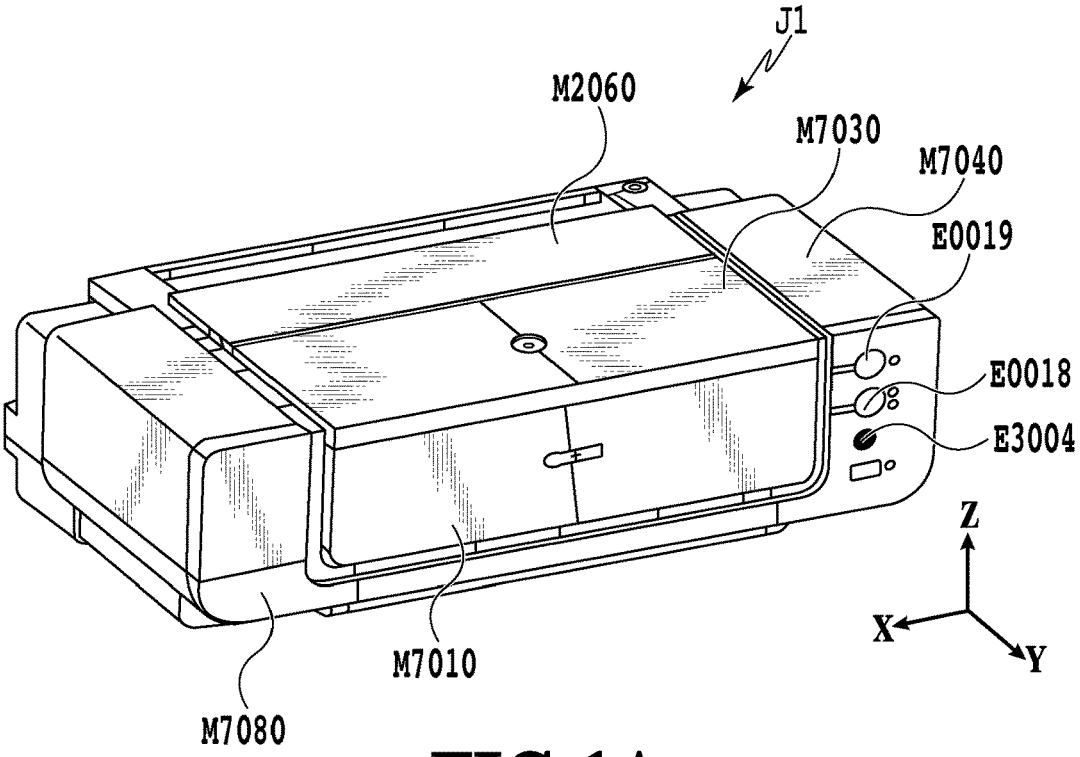
FIGS. 1A and 1B are perspective views of an exterior of a printing apparatus J1.
Figure 1B:
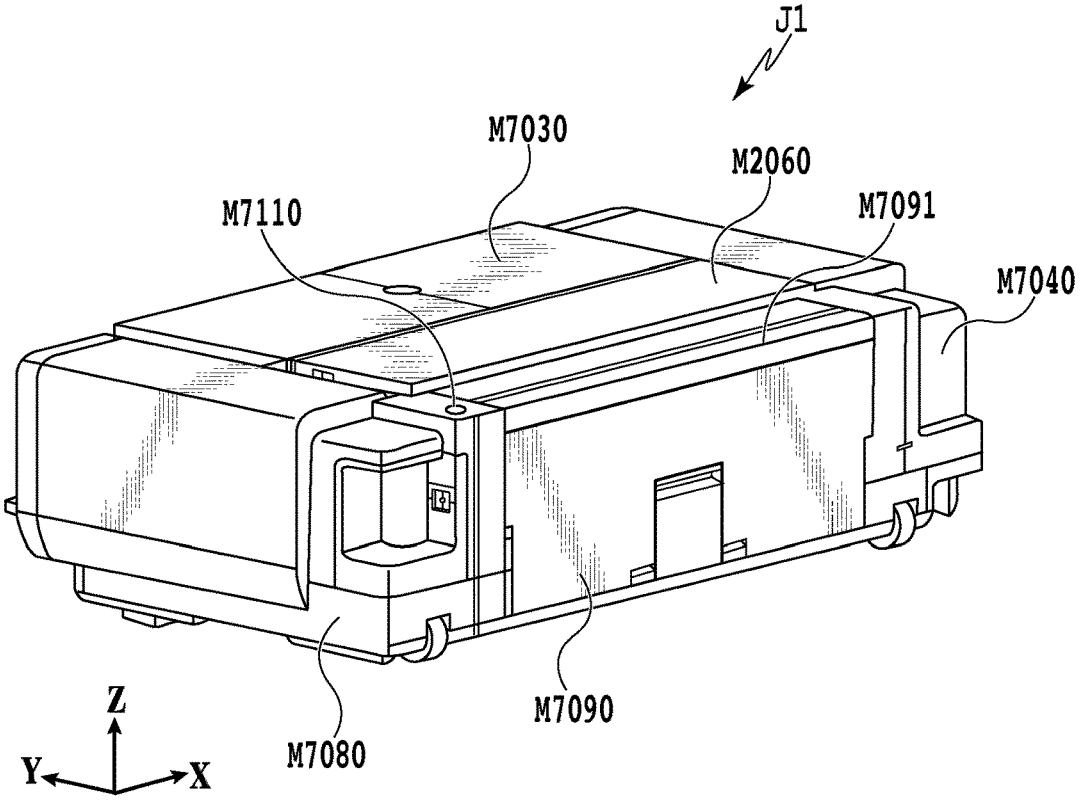

FIGS. 1A and 1B are perspective views of an exterior of the printing apparatus J1. FIG. 1A illustrates a view seen from a front side, and FIG. 1B illustrates a view seen from a back side. Main components of the printing apparatus J1 are accommodated in a housing formed of a lower case M7080 and an upper case M7040. The printing apparatus J1 includes an access cover M7030 and a sheet feed tray M2060 at the upper surface, a front tray M7010 at the front surface, and a rear tray M7090 at the back surface. Each of these are provided so as to be openable and closable.

The access cover M7030 is a cover that is opened in a case of replacing a later-described print head H1001 or an ink tank(s) H1900. The sheet feed tray M2060 is a tray that is opened to the back side to load and hold print media before being printed in the printing apparatus J1. The front tray M7010 is a tray that is opened to the near side to stack and hold print media after being printed in the printing apparatus J1. The rear tray M7090 is a tray that is opened to the back side to support print media in a case of performing later-described flat-pass printing.

A power key E0018, a resume key E0019, a flat-pass key E3004, and so on are provided on the front surface of the upper case M7040. Moreover, a rear tray button M7110 for opening the rear tray M7090 is disposed on the far side of the upper surface of the upper case M7040.

Figure 2:
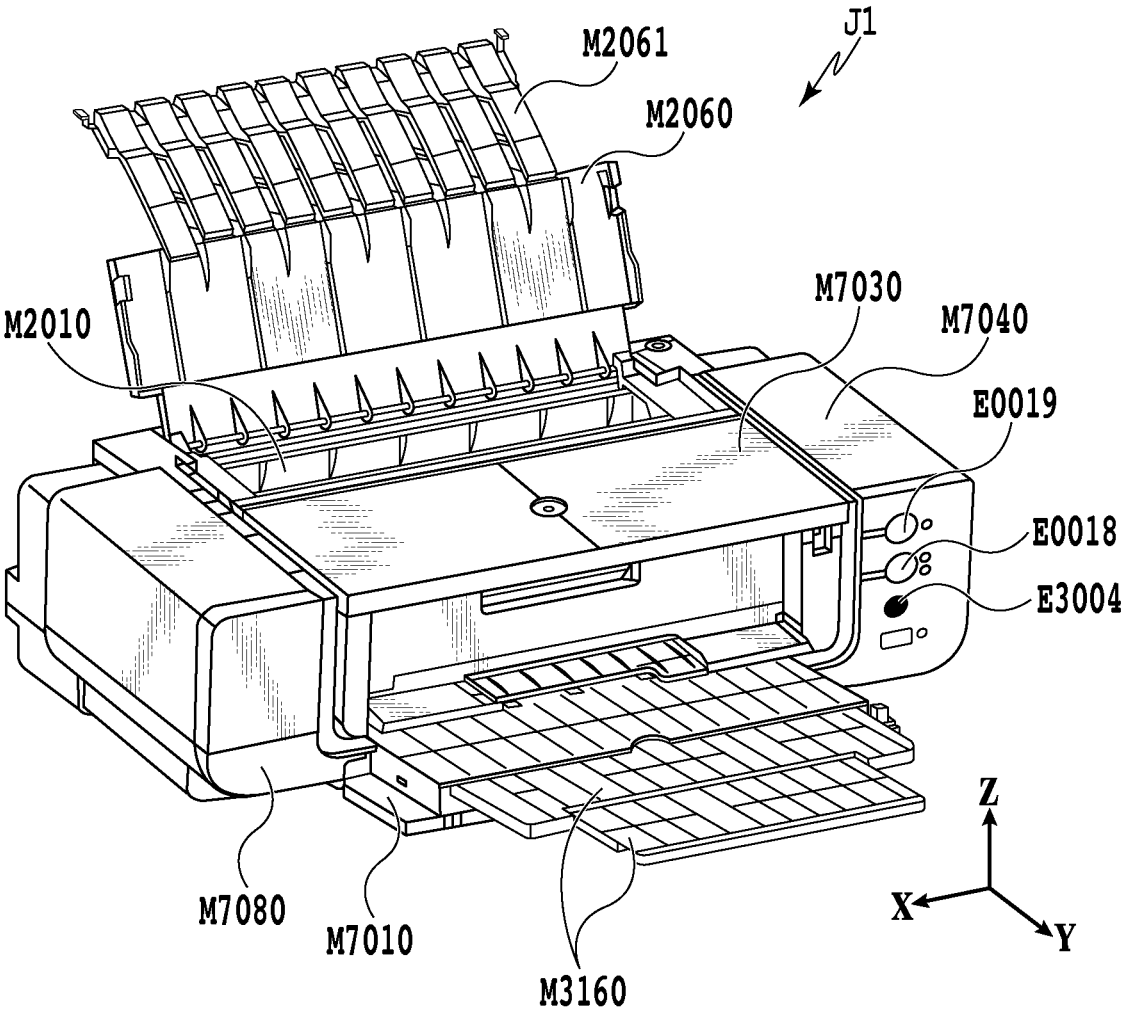
FIG. 2 is a view illustrating a state where a sheet feed tray and a front tray are opened.

FIG. 2 illustrates a state where the sheet feed tray M2060 and the front tray M7010 are opened. On the inner side of the sheet feed tray M2060, a sub tray M2061 for supporting long print media is provided so as to be extendable. On the inner side of the front tray M7010, a sheet discharge tray M3160 for receiving printed print media is provided so as to be extendable. In a case of printing a print medium with relatively low stiffness and high flexibility, such as plain paper, the user sets the sheet feed tray M2060 and the front tray M7010 as illustrated in FIG. 2 and loads the print medium onto the sheet feed tray M2060. As the printing is started, the print medium is fed from the sheet feed tray M2060 into the printing apparatus J1, and the print medium after the printing is discharged and stacked onto the sheet discharge tray M3160. The sheet discharge tray M3160 is formed such that its front end in the Y direction and its both ends in the X direction are higher than its center. This improves the quality of stacking of discharged print media.

FIG. 3 illustrates a state where the rear tray M7090 is opened. In response to the user pressing the rear tray button M7110, the rear tray M7090 is opened to the back side, and further a rear sub tray M7091 accommodated in the rear tray M7090 is extended in a V-shape.

The rear tray M7090 is a tray to be used in a case of performing the flat-pass printing. In the flat-pass printing in the present embodiment, a print medium is fed from the front tray M7010 and switched back, and then a printing operation is performed on the print medium. The rear tray M7090 serves to flatly hold the print medium fed into the apparatus that is yet to be printed or being printed. The flat-pass printing will be specifically described later.

Figure 4A:
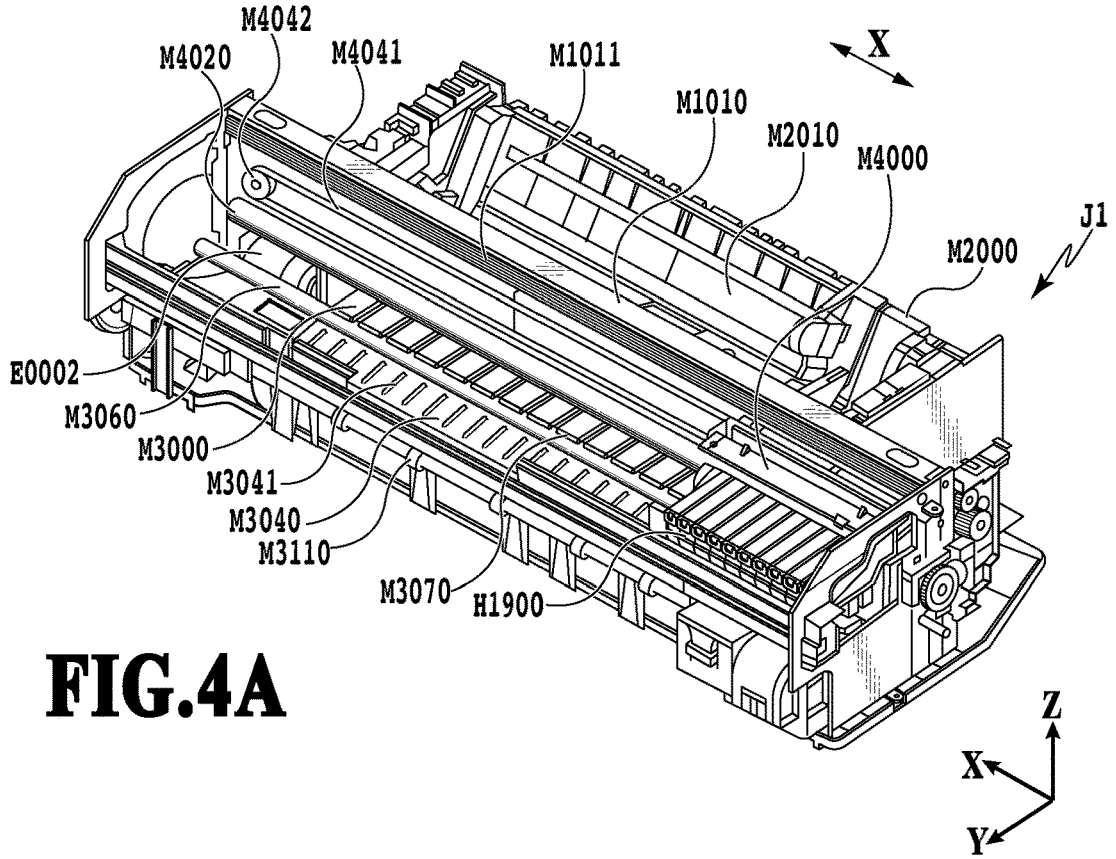
FIGS. 4A and 4B are perspective views for explaining an internal configuration of the printing apparatus.
Figure 4B:
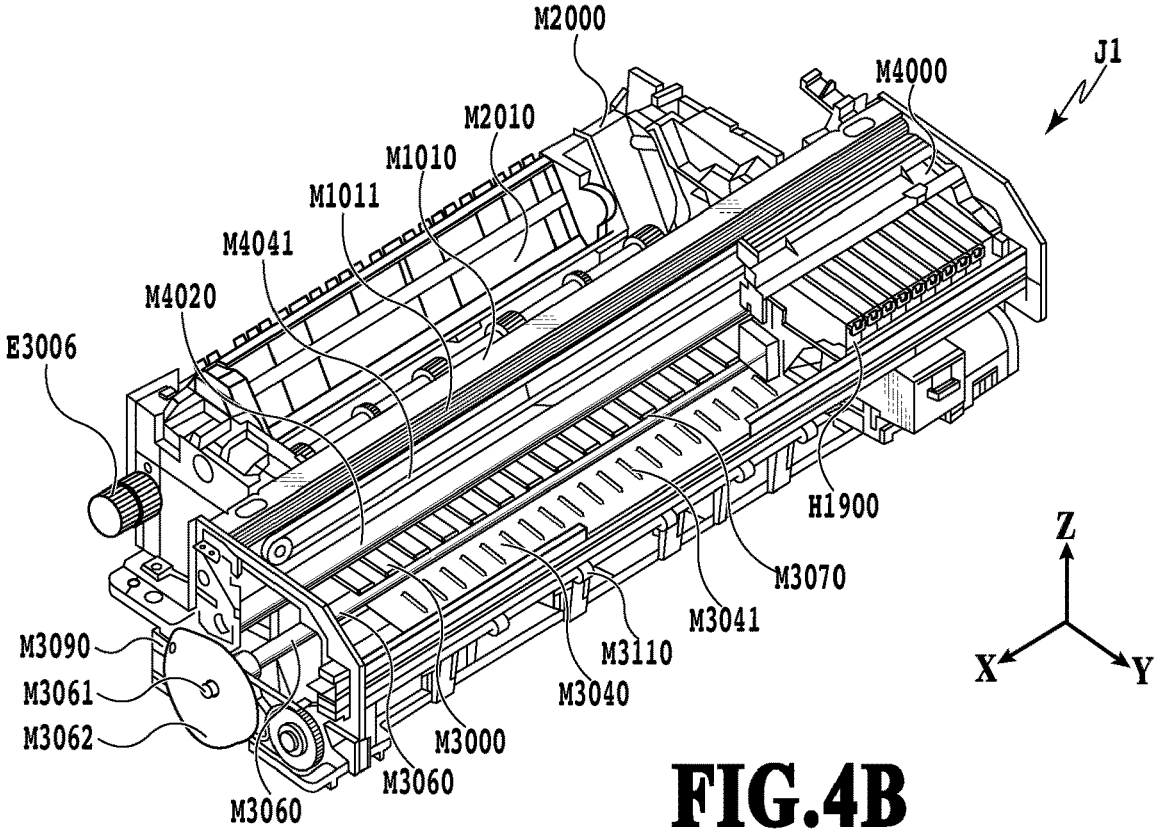
Figure 5:
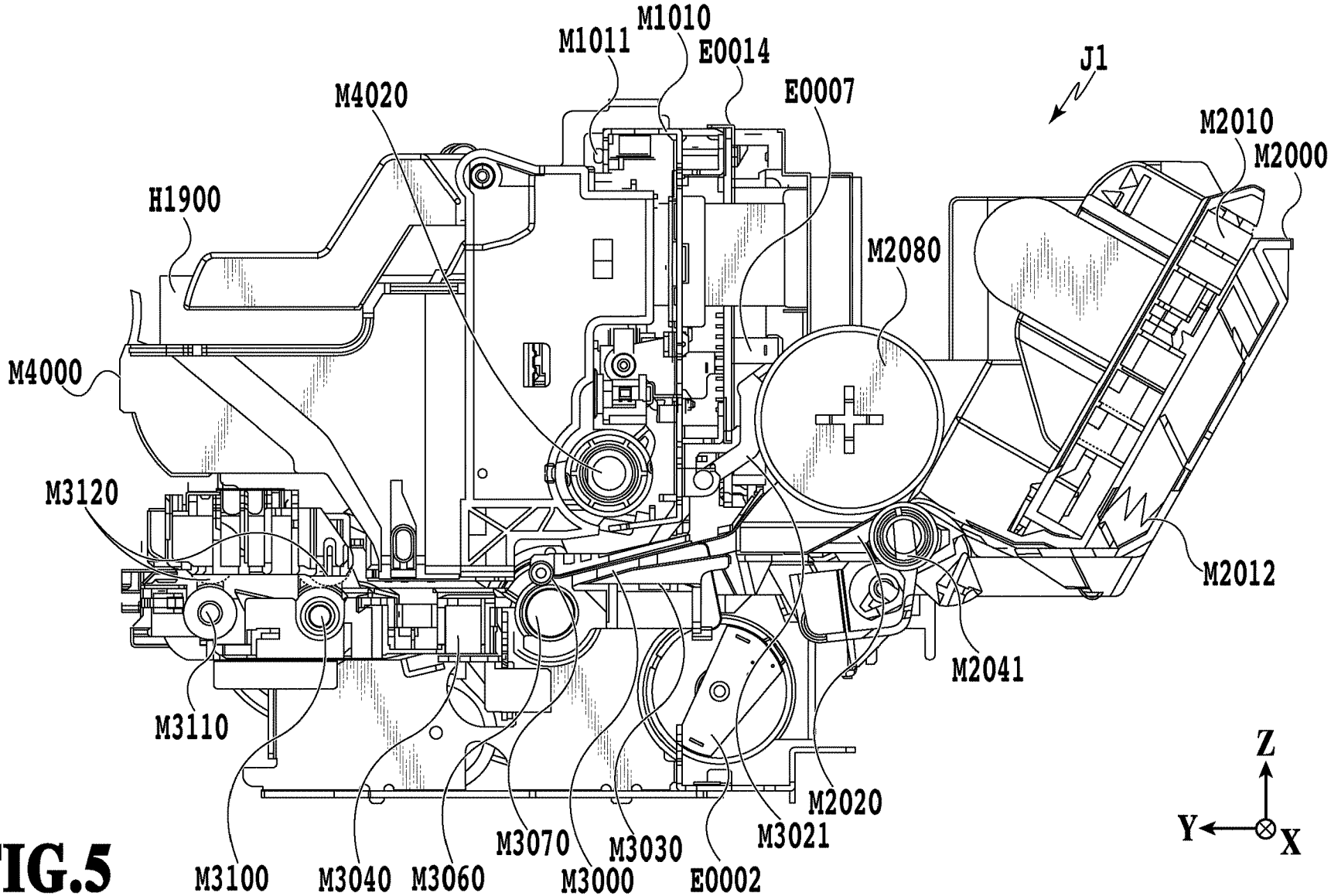
FIG. 5 is a cross-sectional view for explaining the internal configuration of the printing apparatus.

FIGS. 4A, 4B, and 5 are views illustrating an internal configuration of the printing apparatus J1. FIG. 4A is a perspective view from a front right side, FIG. 4B is a perspective view from a front left side, and FIG. 5 is a cross-sectional view.

(B) Sheet Feed Unit

A sheet feed unit includes a pressure plate M2010, a sheet feed roller M2080, a separation roller M2041, a return lever M2020, and so on, and these components are attached to a base M2000. The pressure plate M2010 holds print media loaded thereon together with the sheet feed tray M2060. The sheet feed roller M2080 contacts the top print medium among the print media loaded on the pressure plate M2010 and feeds it to the inside. The separation roller M2041 separates the print media other than the top print medium from the top print medium to prevent them from being fed into the apparatus. The return lever M2020 returns the print media other than the top print medium separated by the separation roller M2041 to the loading position.

(C) Conveyance Unit

The print medium fed by the sheet feed unit is guided by a paper guide flapper M3030 and a pinch roller holder M3000 and reaches a nip portion between a conveyance roller M3060 and pinch rollers M3070. In the conveyance unit, the print medium is nipped by the nip portion between the conveyance roller M3060 and the pinch rollers M3070 and conveyed in the Y direction with rotation of the conveyance roller M3060.

The conveyance roller M3060, which extends in the X direction, is a metallic shaft with a surface coated with ceramic micro-particles, and is attached to a chassis M1010 with bearings receiving metallic portions at both ends. A plurality of pinch rollers disposed in the direction of extension of the conveyance roller M3060 (X direction) are held on the pinch roller holder M3000, which is capable of moving pivotally, and are capable of being rotated by the conveyance roller M3060.

A roller tension spring not illustrated biases the conveyance roller M3060 to apply an appropriate amount of load during rotation. This enables stable conveyance. Also, a pinch roller spring not illustrated biases the pinch rollers M3070 toward the conveyance roller M3060 to generate an appropriate amount of force to convey the print medium. Note that the pinch roller holder M3000 has a rotation shaft attached to bearings on the chassis M1010, and all of the plurality of pinch rollers M3070 pivot about the position of these bearings according to the thickness of the print medium.

APE sensor lever M3021 is attached to the pinch roller holder M3000, and passes through a detection area of a PE sensor E0007 fixed to the chassis M1010 as the pinch roller holder M3000 pivots. The PE sensor E0007 is capable of detecting that an edge of a print medium has passed the nip portion between the conveyance roller M3060 and the pinch rollers M3070 based on whether the detection area is blocked.

The print medium conveyed by the conveyance roller M3060 and the pinch rollers M3070 reaches a platen M3040. The position of the platen M3040 is a printing position at which the print medium receives inks ejected from the print head H1001 (not illustrated in FIGS. 4A to 5). A plurality of platen ribs M3041 are arrayed in the X direction on the platen M3040, and the head-to-medium distance between the print head H1001 and the print medium surface is managed by the height of the platen ribs M3041. Note that the platen ribs M3041 also serve to prevent the print medium from becoming wavy.

Driving force for the conveyance roller M3060 to rotate is obtained, for example, by transmitting rotary force of an LF motor E0002, which is a DC motor, via a timing belt not illustrated to a pulley M3061 arranged on the shaft of the conveyance roller M3060. Also, a code wheel M3062 for detecting the amount of conveyance by the conveyance roller M3060 is provided on the shaft of the conveyance roller M3060. An LF encoder sensor M3090 attached to the chassis M1010 reads markings formed on the code wheel M3062 to detect the amount of rotation of the conveyance roller M3060. Note that the markings formed on the code wheel M3062 are formed at a pitch of 150 to 300 lpi (lines/inch; reference values).

(D) Sheet Discharge Unit

In a sheet discharge unit, the print medium is nipped by nip portions between two sheet discharge rollers M3100 and M3110 and a plurality of spur rollers M3120 and discharged in the Y direction with rotation of the sheet discharge rollers M3100 and M3110.

The sheet discharge rollers M3100 and M3110 each include a metallic shaft extending in the X direction and a plurality of ring-shaped rubber members attached to it. The sheet discharge rollers M3100 and M3110 are driven by transmitting the driving force for the conveyance roller M3060 to them via an idle gear and the like.

The plurality of spur rollers M3120 are each a thin circular plate of SUS or like that has a wavelike shape formed on its periphery and is integrated with a resin part, and is attached to a spur roller holder M3130 capable of being elevated and lowered in the Z direction. The spur rollers M3120 are rotated by the sheet discharge rollers M3100 and M3110 and discharge the print medium onto the sheet discharge tray M3160 (see FIG. 2). The spur rollers M3120 are attached to the spur roller holder M3130 with spur roller springs being coil springs provided therebetween in the form of rods. With the spring force of the coil springs, the nipping force between the sheet discharge rollers M3100 and M3110 and the spur rollers M3120 is appropriately adjusted.

(E) Printing Unit

A printing unit prints an image by ejecting inks from the print head H1001 onto the print medium present on the platen M3040 while scanning the carriage M4000 carrying the print head H1001 in the X direction, which crosses the conveyance direction. On the carriage M4000 are mounted the print head H1001 and the plurality of ink tanks H1900, which supply inks as print materials to the print head H1001. In the present embodiment, ink tanks H1900 for 10 colors of cyan, light cyan, magenta, light magenta, yellow, red, green, first black, second black, and gray are mounted. In the print head H1001, 10 nozzle arrays corresponding respectively to inks of these 10 colors are arrayed in the X direction, and an ejection operation is performed in accordance with print data from individual nozzles each serving as an inkjet printing element capable of applying an ink onto a print medium. Note that in the present embodiment, each nozzle array includes 768 nozzles arrayed at a pitch of 1200 dpi in the Y direction.

The carriage M4000 is capable of being moved reciprocally in the X direction while being guided and supported by a guide shaft M4020 attached to the chassis M1010 and extending in the X direction and a guide rail M1011 formed integrally with the chassis M1010. The carriage M4000 is moved by transmitting driving force of a carriage motor E0001 (see FIG. 6A) to it via an idle pulley M4042 and a timing belt M4041.

Figure 6A:
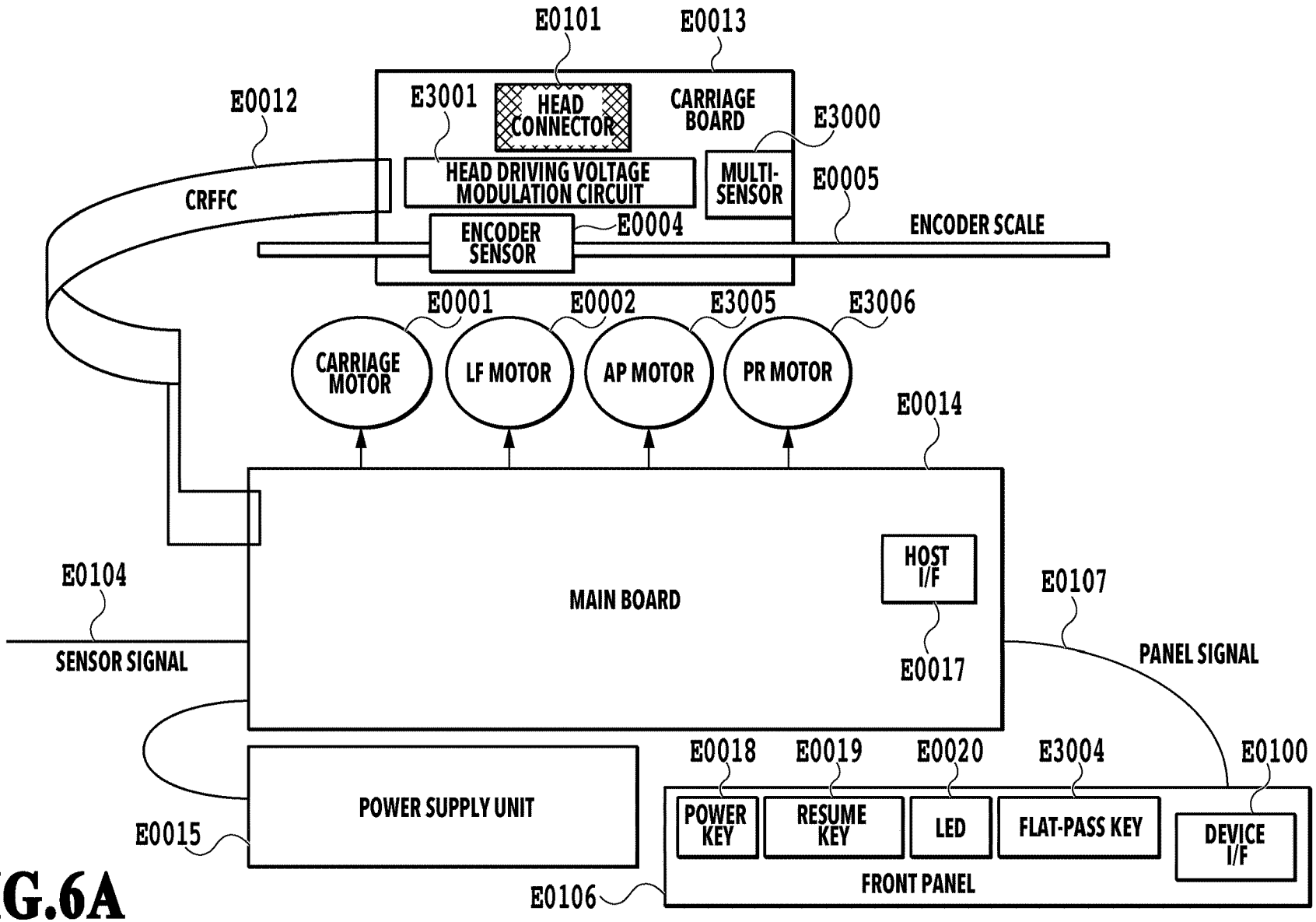
FIGS. 6A and 6B are block diagrams for explaining an electric circuit configuration.

Here, refer to FIG. 6A. The position of the carriage M4000 thus moved can be recognized by detecting markings on an encoder scale E0005 extending in the X direction with an encoder sensor E0004 disposed on a carriage board E0013. Note that in the present embodiment, the markings are formed on the encoder scale E0005 at a pitch of 150 lpi to 300 lpi.

To the carriage board E0013 is connected a flexible cable E0012 that sends a driving signal transmitted by a main board E0014 while following the movement of the carriage M4000. The driving signal received from the flexible cable E0012 is sent to the print head H1001 via a head connector E0101. The print head H1001 performs an ink ejection operation in accordance with the X-direction position information detected by the encoder sensor E0004 and the driving signal. The print head H1001 performs the ejection operation while the carriage M4000 moves in the X direction to print an image of one band onto the print medium.

By alternately repeating a printing scan of one band as above and a conveyance operation of conveying the print medium in the Y direction by a distance corresponding to the one band by means of the conveyance roller M3060, a desired image is formed on the print medium.

(F) Flat-Pass Conveyance Path

The series of paths formed by the sheet feed unit, the conveyance unit, and the sheet discharge unit described above are not flat, as is obvious from FIG. 5. A print medium with relatively low stiffness and high flexibility, such as plain paper, can be smoothly conveyed through such a path. It is, however, difficult to convey a print medium with high stiffness and low flexibility. Even if the print medium could be conveyed, it might be scratched, for example. Thus, in the printing apparatus in the present embodiment, in addition to the general conveyance path described above, a flat conveyance path for thick papers and high-stiffness print media is prepared to enable flat-pass printing in which such a print medium is conveyed through this path and an image is printed onto the print medium.

Figure 3A:
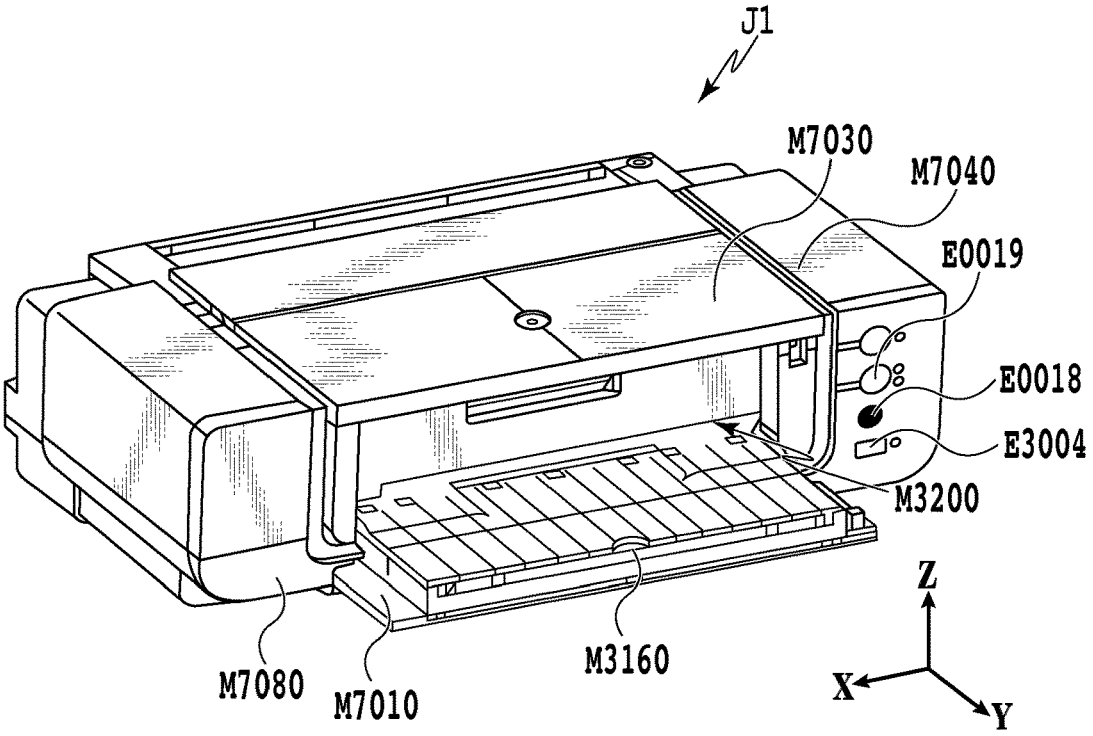
FIGS. 3A and 3B are views illustrating a state for performing flat-pass printing.
Figure 3B:
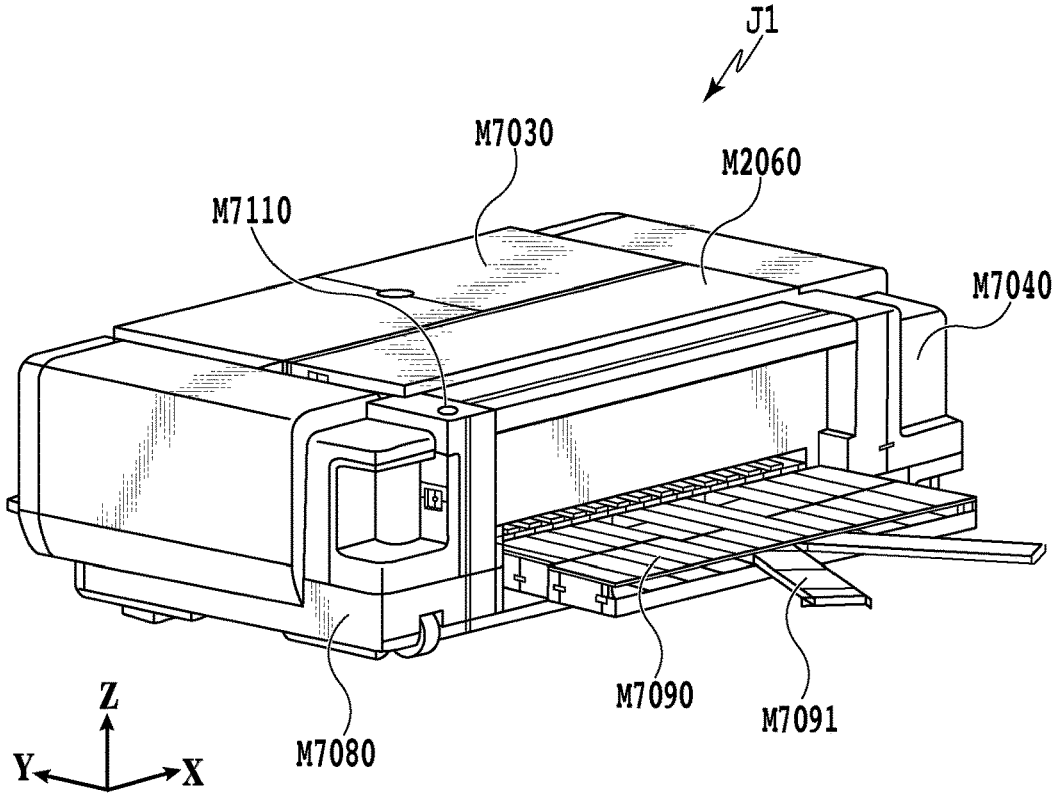

FIGS. 3A and 3B are diagrams illustrating the state of the sheet discharge tray M3160 and the rear tray M7090 in the case of performing the flat-pass printing. In the case of performing the flat-pass printing, the user presses the rear tray button M7110. As a result, the rear tray M7090 is opened to the back side and the rear sub tray M7091 accommodated in the rear tray M7090 is extended in a V-shape. Also, the user lifts up the front tray M7010 in an opened state to engage the front tray M7010 with a hook not illustrated. As a result, the front tray M7010 is positioned at the height of the sheet discharge port in the Z direction, so that a conveyance path which enables substantially horizontal conveyance is formed. Note that the sheet discharge tray M3160 is not extended.

The user further presses the flat-pass key E3004. As a result, the spur roller holder M3130 and the pinch roller holder M3000 are elevated according to the thickness of the print medium (see FIG. 5). By the above, a flat conveyance path is formed along which the front tray M7010, the platen M3040, and the rear tray M7090 are connected substantially horizontally.

In the case of performing the flat-pass printing, the user places the print medium on the front tray M7010 while aligning it with a marker on the front tray M7010, and inserts the print medium from an outlet M3200. The sheet discharge rollers M3110 and M3100 and the conveyance roller M3060 are rotated in the direction opposite to that in the normal printing operation to move the print medium in a −Y direction and positioned so as to set the trailing edge of the inserted print medium as the leading edge in a +Y direction in the printing unit. Here, the rear tray M7090 supports the portion of the print medium projecting from the back of the apparatus from below.

Thereafter, as in the case with a normal print medium, a printing scan and a conveyance operation are alternately repeated to print a desired image onto the print medium. The print medium after the image is printed is discharged onto the front tray M7010, from which the print medium was initially inserted. With flat-pass printing as described above, a high-quality printing operation can be performed even on thick paper or a high-stiffness print medium without making a fold or bend on it.

1.2 Electric Circuit Configuration

FIG. 6A is a block diagram for explaining a schematic configuration of an electric circuit in the printing apparatus J1. The electric circuit in the printing apparatus J1 mainly includes the carriage board E0013, the main board E0014, a power supply unit E0015, and a front panel E0106.

The power supply unit E0015 is connected to the main board E0014 and supplies power to constituent mechanisms in the printing apparatus J1.

The carriage board E0013 is a printed circuit board mounted on the carriage M4000, and is connected to the main board E0014 via the flexible cable E0012, which follows movement of the carriage M4000. On the carriage board E0013, the head connector E0101 is a contact pad for electrically connecting the carriage board E0013 to the print head H1001 mounted on the carriage M4000. A head driving voltage modulation circuit E3001 generates a driving voltage for driving the print head H1001 in accordance with a condition designated by the main board E0014 and supplies the driving voltage to the print head H1001 via the head connector E0101.

The encoder sensor E0004 detects markings on the encoder scale E0005 extending in the X direction inside the printing apparatus J1 and sends a detection signal to the main board E0014. A multi-sensor E3000 includes a plurality of sensors such as an optical sensor and a thermistor and sends various detection values to the main board E0014.

The main board E0014 is a printed circuit board unit that controls the driving of components in the inkjet printing apparatus J1. The main board E0014 includes an interface for sending and receiving data to and from an external host apparatus J2 (host I/F E0017).

The main board E0014 is connected to various motors such as the carriage motor E0001, the LF motor E0002, an AP motor E3005, and a PR motor E3006 and controls each of the motors. The carriage motor E0001 is a motor serving as a driving source for scanning the carriage M4000 in the X direction. The LF motor E0002 is a motor serving as a driving source for rotating the conveyance roller M3060 and the sheet discharge rollers M3100 and M3110 to convey a print medium. The AP motor E3005 is a motor serving as a driving source for performing an operation of recovering the print head H1001 and an operation of feeding a print medium. The PR motor E3006 is a motor serving as a driving source for preparing the conveyance path for the flat-pass printing.

Detection signals from the PE sensor E0007 and the LF encoder sensor M3090 described above and various other sensors disposed on components in the apparatus are sent to the main board E0014 by means of a sensor signal E0104. The main board E0014 is connected also to the front panel E0106 and sends and receives information to and from the front panel E0106 by means of a panel signal E0107.

The front panel E0106, which is provided on the front of the printing apparatus J1, is a user interface for receiving instructions from the user and presenting information to the user. In the front panel E0106 are disposed the power key E0018, the resume key E0019, an LED E0020, and the flat-pass key E3004, and also a device I/F E0100 to be used to connect the apparatus to a peripheral device, such as a digital camera.

Figure 6B:
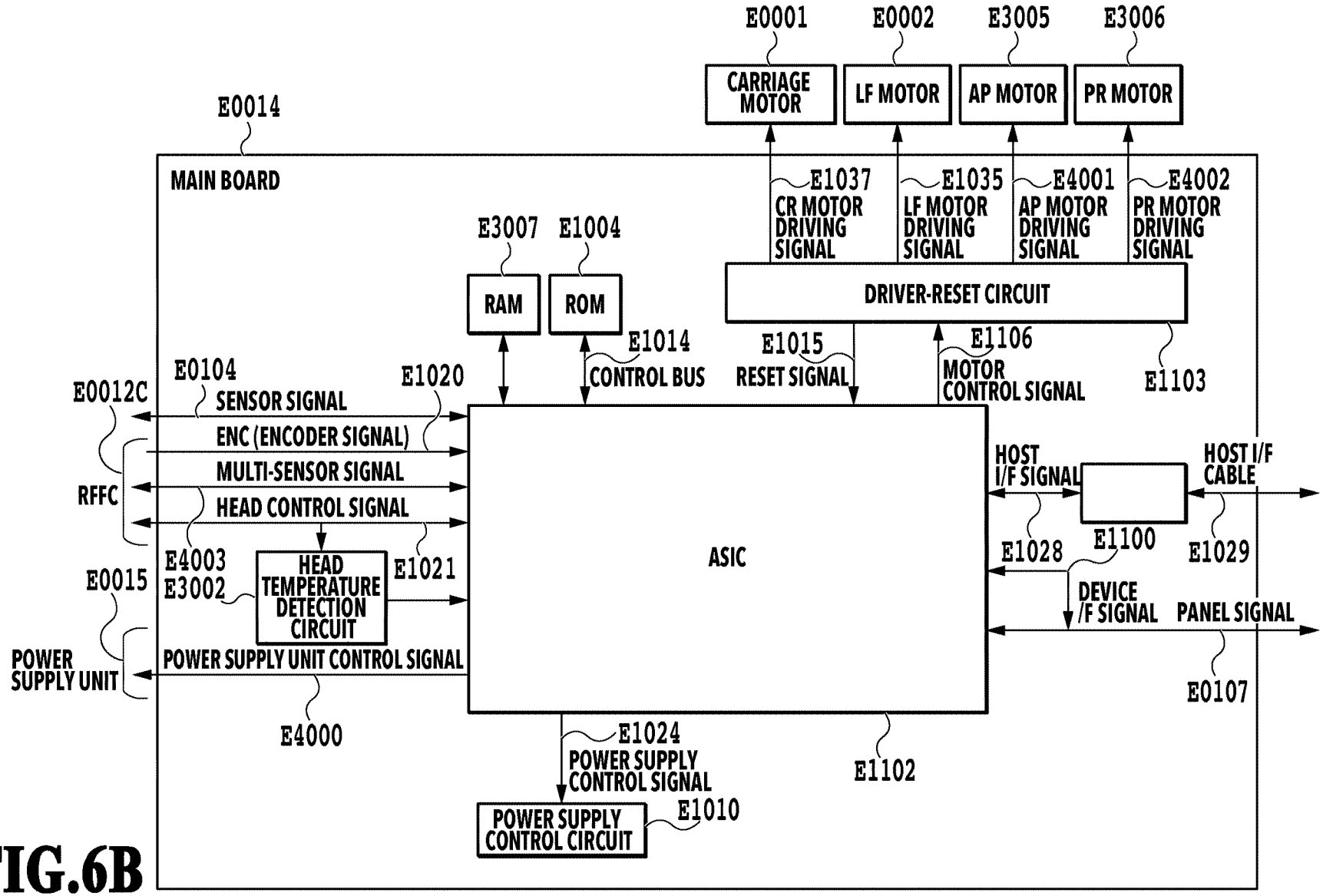

FIG. 6B is a block diagram illustrating an internal configuration of the main board E0014. An application specific integrated circuit (ASIC) E1102 is connected to a ROM E1004 via a control bus E1014 and performs various types of control in accordance with programs stored in the ROM E1004. The ASIC E1102 sends and receives, for example, the sensor signal E0104 associated with the various sensors and a multi-sensor signal E4003 associated with the multi-sensor E3000. The ASIC E1102 also detects an encoder signal E1020 and the states of outputs from the power key E0018, the resume key E0019, and the flat-pass key E3004 on the front panel E0106. The ASIC E1102 also controls the driving of the inkjet printing apparatus controls constituent elements by performing various logical operations, making conditional judgments, etc. in accordance with the connection and data input states of the host I/F E0017 and the device I/F E0100 on the front panel to thereby control the driving of the inkjet printing apparatus.

A driver-reset circuit E1103 generates a CR motor driving signal E1037, an LF motor driving signal E1035, an AP motor driving signal E4001, and a PR motor driving signal E4002 in accordance with a motor control signal E1106 from the ASIC E1102. The driver-reset circuit E1103 then drives the motors in accordance with the respective driving signals thus generated. The driver-reset circuit E1103 has a power supply circuit and supplies necessary power to components such as the main board E0014, the carriage board E0013, and the front panel E0106. Further, in response to detecting a decrease in power supply voltage, the driver-reset circuit E1103 generates a reset signal E1015 and performs initialization.

A power supply control circuit E1010 controls the supply of power to the sensors having a light emitting element and the like in accordance with a power supply control signal E1024 from the ASIC E1102.

The host I/F E0017 transfers a host I/F signal E1028 from the ASIC E1102 to a host I/F cable E1029 connected to the outside and also transfers a signal from this cable E1029 to the ASIC E1102.

Power supplied from the power supply unit E0015 is converted into voltage at the main board E0014 as necessary and supplied to components inside and outside the main board E0014. The power supply unit E0015 controls a low-power consumption mode and the like of the printing apparatus J1 in accordance with a power supply unit control signal E4000 received from the ASIC E1102.

The ASIC E1102 is a semiconductor integrated circuit incorporating a single-chip arithmetic processing apparatus, and outputs the above-mentioned motor control signal E1106, power supply control signal E1024, and power supply unit control signal E4000, and so on. Then, the ASIC E1102 sends and receives signals to and from the host I/F E0017 and also sends and receives signals to and from the device I/F E0100 on the front panel by means of the panel signal E0107. Further, the ASIC E1102 controls sensors on components such as the PE sensor and an auto sheet feeder sensor by means of the sensor signal E0104, and controls the multi-sensor E3000 by means of the multi-sensor signal E4003. Furthermore, the ASIC E1102 detects the states of these sensors and also detects the states of the panel signal E0107, and controls the driving of the panel signal E0107 to flash the LED E0020 on the front panel.

Moreover, the ASIC E1102 detects the states of an encoder signal (ENC) E1020 and generates a timing signal, and is interfaced with the print head H1001 by means of a head control signal E1021 to control a printing operation. Here, the encoder signal (ENC) E1020 is an output signal from the encoder sensor E0004 inputted via the flexible cable E0012. The head control signal E1021 is connected to the carriage board E0013 via the flexible cable E0012. The head control signal E1021 is supplied to the print head H1001 via the head driving voltage modulation circuit E3001 and the head connector E0101, and transfers various pieces of information from the print head H1001 to the ASIC E1102. Among these pieces of information, head temperature information on each ejection unit is subjected to signal amplification at a head temperature detection circuit E3002 on the main board and then inputted into the ASIC E1102 and used to make various control determinations.

In FIG. 6B, E3007 denotes a DRAM which is used as a buffer for print data, a buffer for data received from a host computer, and the like and also as a work area necessary for various control operations.

1.3 Overview of Image Processing

Figure 7:
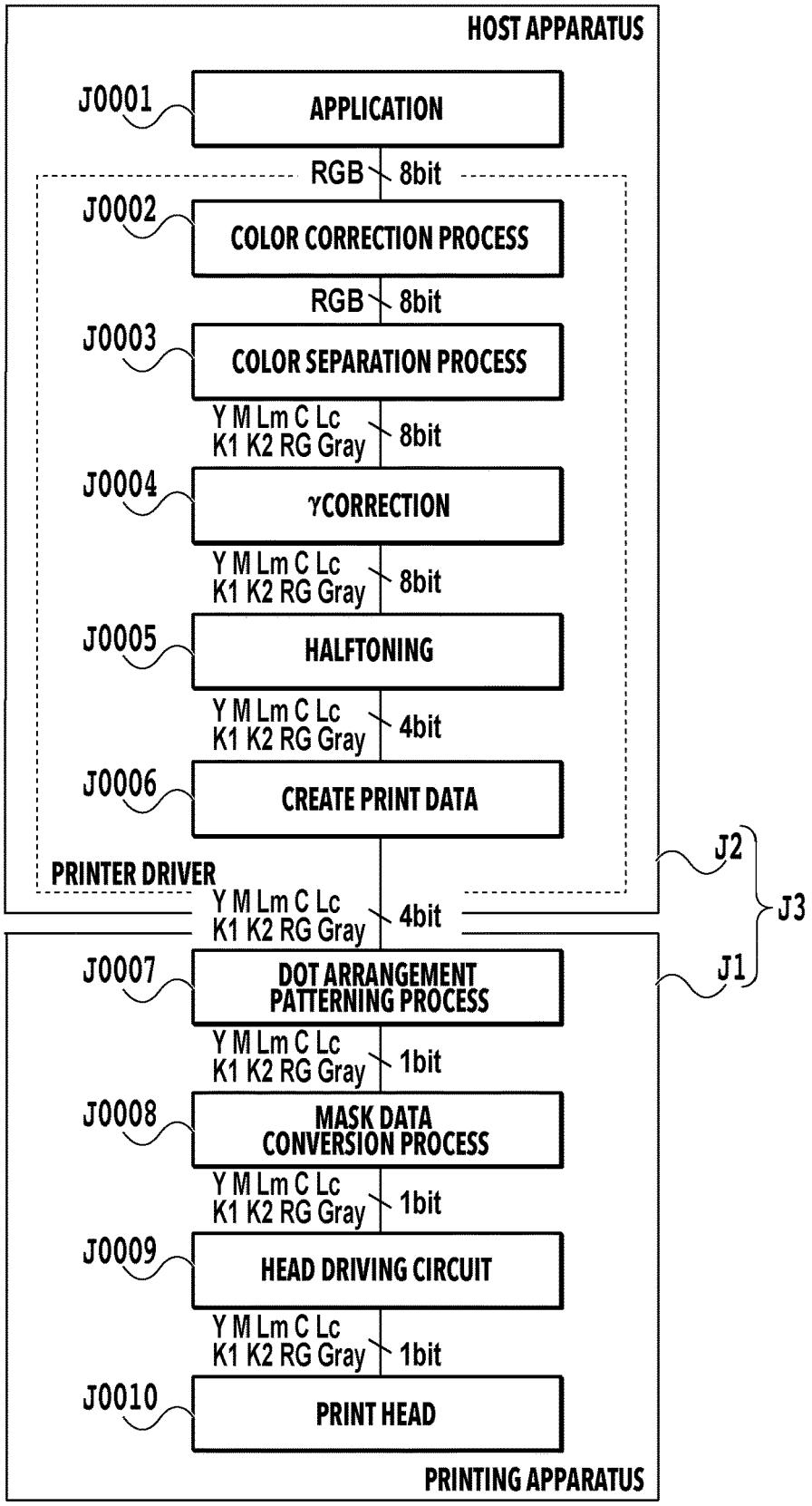
FIG. 7 is a diagram for explaining a flow of image processing.

FIG. 7 is a diagram for explaining a flow of image processing in a printing system J3 in the present embodiment. The printing system J3 in the present embodiment includes the host apparatus J2 and the printing apparatus J1.

The host apparatus J2 includes an application J0001 and a printer driver as programs that run on the operating system of the host apparatus J2. The application J0001 generates image data to be printed by the printing apparatus, and the printer driver performs predetermined image processing on the image data generated by the application J0001 to generate image data that can be received by the printing apparatus J1. In the present embodiment, the image data outputted from the application J0001 to the printer driver is RGB luminance data having a resolution of 600 dpi. Specifically, it is image data in which each of pixels arranged at a resolution of 600 dpi has an 8-bit 256-tone pixel value (luminance value) for each of red (R), green (G), and blue (B) under the sRGB standard.

The printer driver performs a color correction process J0002, a color separation process J0003, γ correction J0004, halftoning J0005, and a print data creation process J0006 on the image data received from the application J0001.

In the color correction process J0002, gamut mapping is performed. In the present embodiment, the gamut expressed by the color space of the sRGB standard is mapped to the color space that can be represented by the printing apparatus J1. Specifically, a three-dimensional LUT is used to convert the 8-bit 256-tone RGB data into 8-bit 256-tone R'G'B' data.

In the color separation process J0003, the above 8-bit 256-tone R'G'B' data is converted into 8-bit 256-tone density data for each of the ink colors Y, M, Lm, C, Lc, K1, K2, R, G, Gray used in the printing apparatus J1. In the color separation process J0003 too, a three-dimensional LUT is used, and the above process is performed with an interpolation process.

In the γ correction J0004, tone value conversion is performed on the density data of each color obtained by the color separation process J0003. Specifically, a one-dimensional LUT corresponding to the tone characteristics of the ink of each color used in the printing apparatus J1 is used to perform such conversion that the density data is linearly associated with the tone characteristics of the printing apparatus J1.

In the halftoning J0005, a quantization process using an error diffusion method is performed on each piece of 8-bit 256-tone color separation data subjected to the γ correction to generate a piece of 4-bit 9-tone quantized data. The pieces of quantized data thus generated will be reference values for setting dot arrangement patterns in a later-described dot arrangement patterning process.

In the print data creation process J0006, print data is created in which printing control information is added to print image data containing the above pieces of quantized data as its content.

Figure 8:
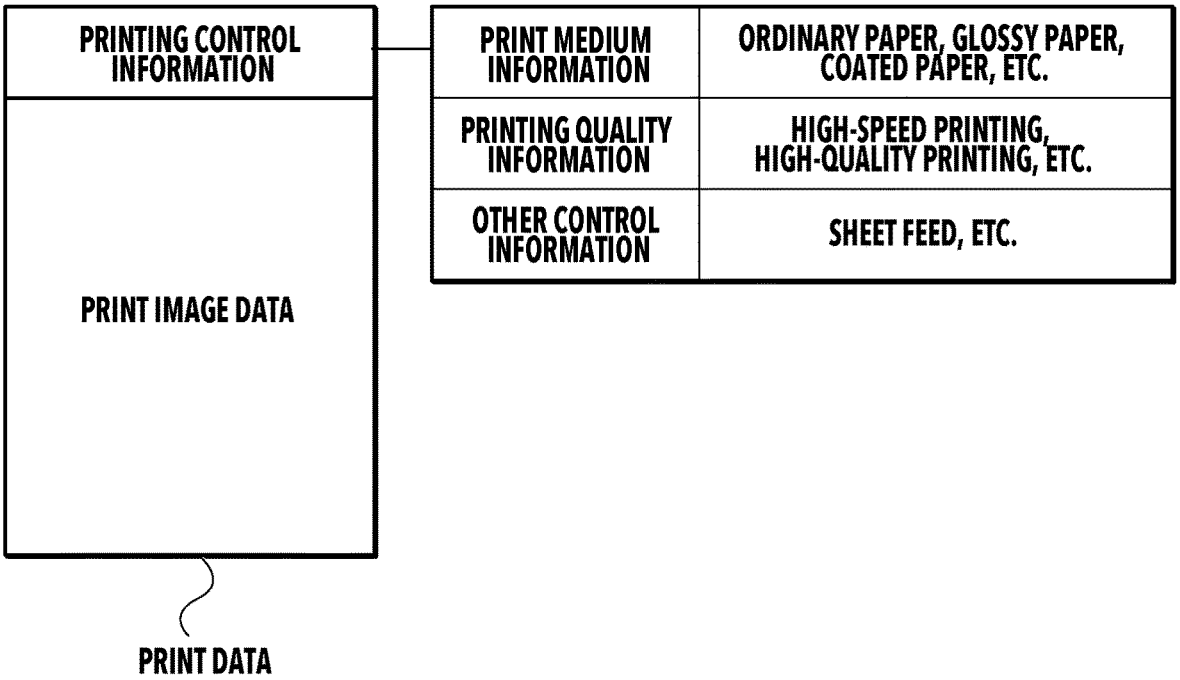
FIG. 8 is a diagram illustrating an example configuration of print data.

FIG. 8 is a diagram illustrating an example configuration of print data. The print data contains printing control information for setting the printing method and print image data (the pieces of 4-bit quantized data mentioned above). The printing control information contains "print medium information", "printing quality information", and "other control information". In the print medium information, one type of print medium is set among plain paper, glossy paper, postcard, printable disc, etc. In the printing quality information, printing qualities, such as "beautiful", "standard", and "fast", are set. In the "other control information", various contents such as the sheet feed method indicating whether to use the standard conveyance or the flat-pass conveyance are set. Incidentally, such printing control information is set based on contents designated by the user on a UI screen on the host apparatus J2. The print data generated by the print data creation process J0006 is sent to the printing apparatus J1.

The printing apparatus J1 performs a dot arrangement patterning process J0007 and a mask data conversion process J0008 on the print data received from the host apparatus J2.

In the dot arrangement patterning process J0007, one dot arrangement pattern is selected for each piece of quantized data from among a plurality of dot arrangement patterns prepared in advance. As a result, each piece of 4-bit 9-tone quantized data at 600 dpi is converted into a piece of 1-bit 2-tone dot data at 1200 dpi×2400 dpi. In each piece of 1-bit 2-tone dot data, "1" means to print a dot in the corresponding print pixel (area) whereas "0" means to not print a dot in the corresponding print pixel (area).

Figure 9:
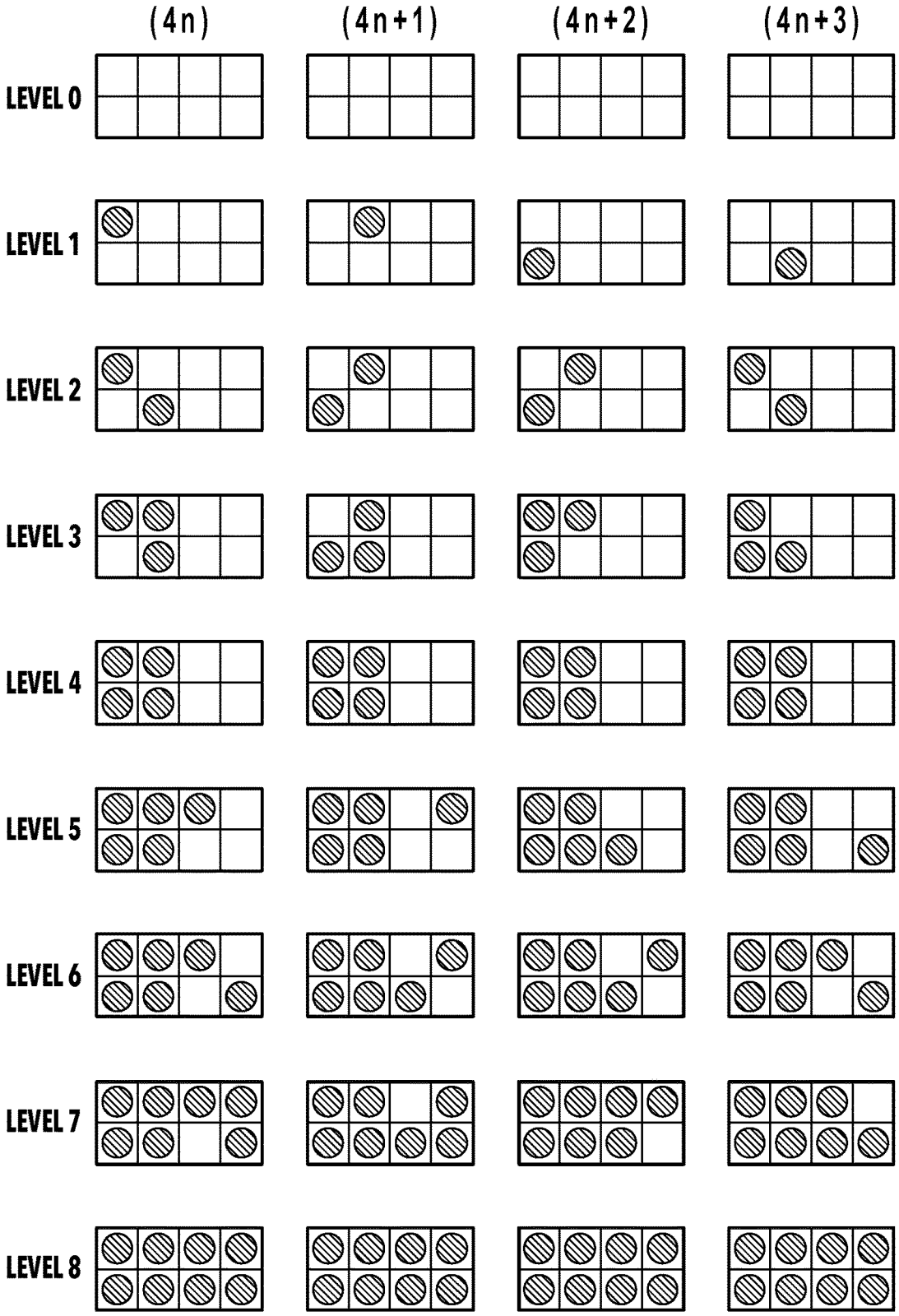
FIG. 9 is a diagram illustrating dot arrangement patterns to be used in a dot arrangement patterning process.

FIG. 9 is a diagram illustrating the plurality of dot arrangement patterns prepared in advance for the dot arrangement patterning process in the present embodiment. The level values presented on the left of FIG. 9 correspond to levels 0 to 8 indicated by the pieces of 4-bit 9-tone quantized data. Each region with two vertical areas×four horizontal areas illustrated on the right side is equivalent to one pixel region at 600 dpi, and each individual rectangle (area) corresponds to one pixel (print pixel) at 1200 dpi×2400 dpi.

In FIG. 9, each area with a circle depicted therein represents an area in which to print a dot, whereas each area with no circle depicted therein represents an area in which to print no dot. The number of areas in which to print a dot increases one by one as the level number increases.

With n replaced with an integer of 1 or greater, (4n) to (4n+3) indicate pixel positions on the print medium in the main scanning direction (X direction). The patterns illustrated under them represent dot arrangement patterns determined in association with the respective pixel positions. Even with the same level value, the dot pattern in each single pixel region (2×4 area) varies depending on the pixel position.

The description now returns to FIG. 7. In the mask data conversion process J0008, it is determined in which printing scan in multipass printing each dot determined to be printed in the dot arrangement patterning process is to be printed.

Figure 10:
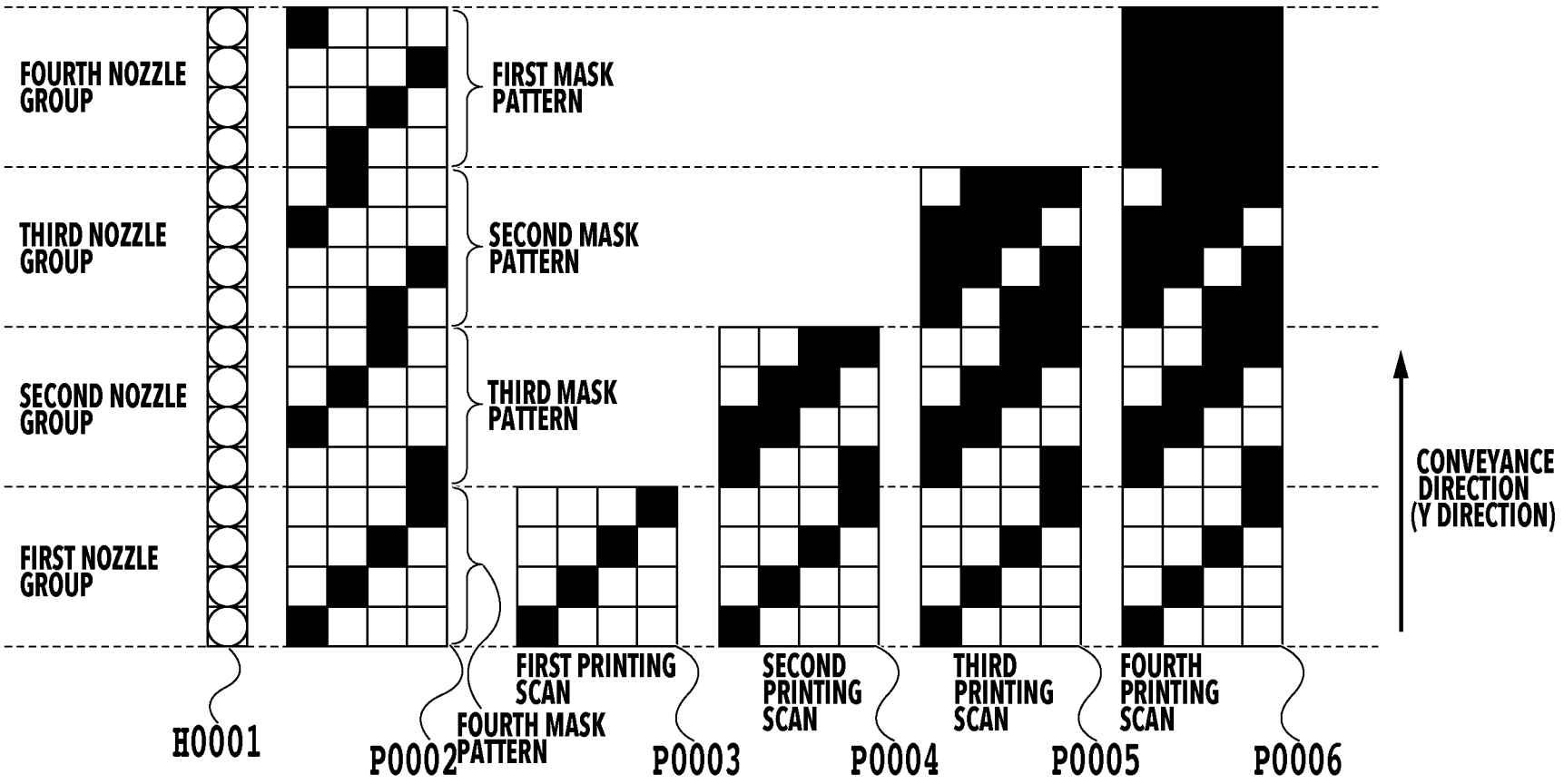
FIG. 10 is a diagram schematically illustrating 4-pass multipass printing.

FIG. 10 is a diagram schematically illustrating 4-pass multipass printing. In the print head H1001 used in the present embodiment, 768 nozzles capable of ejecting an ink of the same color are arrayed in the Y direction. The following, however, assumes that 16 nozzles are arrayed for a simple description.

In a case of performing 4-pass multipass printing, the 16 nozzles arrayed in the Y direction are divided into first to fourth nozzle groups each including 4 nozzles. Further, the first to fourth nozzle groups are associated with first to fourth mask patterns. Each mask pattern has a region of 4 areas×4 areas. Each area illustrated in black represents an area where printing a dot is permitted, whereas each area illustrated in white represents an area where printing a dot is not permitted. The first to fourth mask patterns have such a relationship that they complement each other. In FIG. 10, the first to fourth mask patterns as a whole are illustrated as a mask pattern P0002 to be used by the print head H1001 in the printing scans.

Patterns P0003 to P0006 illustrated in association with the first to fourth printing scans illustrate how an image is completed on a print medium in a case of performing 4-pass multipass printing in accordance with the first to fourth mask patterns. Each time a printing scan is finished, the print medium is conveyed in the Y direction by four nozzles. The image in each unit region (4×4 area) on the print medium is completed by four printing scans following the first to fourth mask patterns having the complementary relationship. By performing multipass printing as above, image impairments originating from variations in ejection characteristics of each individual nozzle and print medium conveyance accuracy can be dispersed over the entire image and made less noticeable in the image.

Figure 11A:
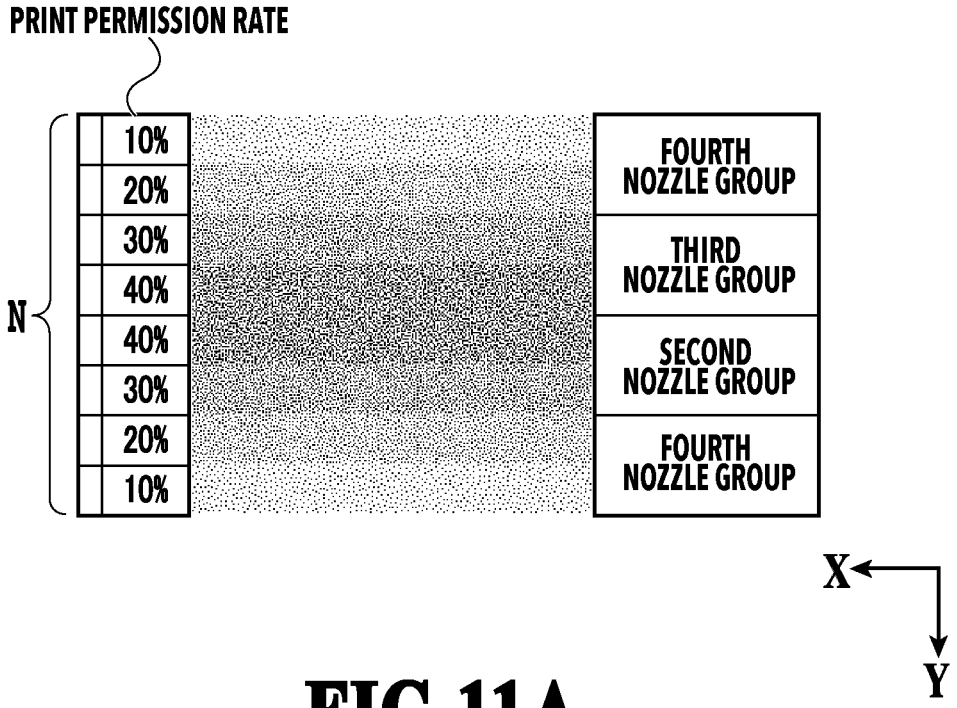
FIGS. 11A and 11B are diagrams illustrating an example of mask patterns.
Figure 11B:
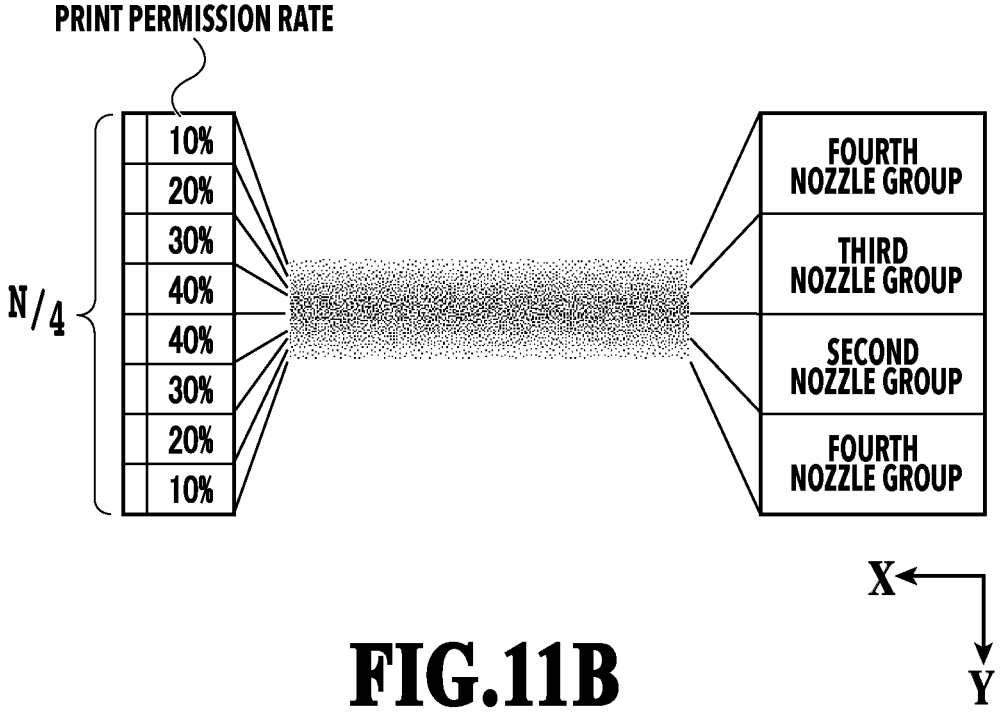

FIGS. 11A and 11B illustrate an example of mask patterns actually used in the printing apparatus in the present embodiment. In FIGS. 11A and 11B, the print permission rate described for each region indicates the proportion of print permitted areas among all areas included in the region.

For example, in the case of the mask patterns in FIG. 10, the print permission rate in each single region is 25% (=4/16).

FIG. 11A illustrates mask patterns that can be used in a case of performing 4-pass multipass printing with the entire region (768 nozzles) of the print head H1001 as the printing-use region. FIG. 11B, on the other hand, illustrates mask patterns that can be used in a case of performing 4-pass multipass printing with ¼ of the entire region (192 nozzles) as the printing-use region.

In the case of performing the 4-pass multipass printing with the entire region as the printing-use region, all 768 nozzles are divided into four nozzle groups each including 192 nozzles. Then, a printing scan following the mask patterns illustrated in FIG. 11A and a conveyance operation over 192 nozzles in the Y direction are alternately repeated to print an image in each unit region in a stepwise manner. On the other hand, in the case of performing the 4-pass multipass printing with ¼ of the entire region as the printing-use region, the 192 nozzles corresponding to this region are divided into four nozzle groups each including 48 nozzles. Then, a printing scan following the mask patterns illustrated in FIG. 11B and a conveyance operation over 48 nozzles in the Y direction are alternately repeated to print an image in each unit region in a stepwise manner.

With an inkjet print head that ejects many small droplets at a high frequency, an air flow is sometimes generated during an ejection operation, so that the traveling direction of ink droplets ejected from nozzles located at end portions is bent and their landing positions deviate. In the present embodiment, image impairments due to the deviation of the landing positions of ink droplets are made unnoticeable by using mask patterns as illustrated in FIGS. 11A and 11B, with which the print permission rate of nozzles at end portions is lower than the print permission rate of nozzles at a center portion.

In the present embodiment, a plurality of mask patterns as illustrated in FIGS. 11A and 11B are stored in a memory in the main body of the printing apparatus in advance. In the mask data conversion process J0008 in FIG. 7, mask patterns corresponding to the printing control information in the print data are selected from among the plurality of mask patterns. Then, an AND process is performed on the selected mask patterns and the pieces of dot data obtained in the dot arrangement patterning process J0007 to determine pieces of dot data to be actually printed in each printing scan. Further, these pieces of dot data are sent as pieces of binary ejection data to a head driving circuit J0009.

The head driving circuit J0009 drives the print head H1001 in accordance with the received pieces of ejection data to eject inks from individual nozzles.

Incidentally, FIG. 7 explains a configuration in which the color correction process J0002 to the print data creation process J0006 are executed in the host apparatus J2 and the dot arrangement patterning process J0007 and the mask data conversion process J0008 are executed in the printing apparatus J1. Alternatively, a series of image processing operations as above may be performed in either the host apparatus J2 or the printing apparatus J1. For example, some of the processes J0002 to J0005 executed in the host apparatus J2 may be executed in the printing apparatus J1, or all of the processes may be executed in either the host apparatus J2 or the printing apparatus J1.

Figure 12A:
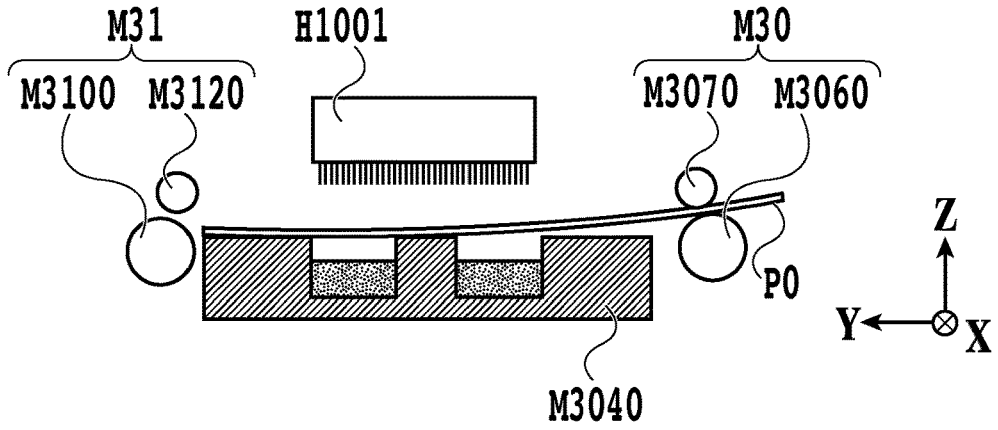
FIGS. 12A to 12C are diagrams for explaining printing control for a low-stiffness print medium.
Figure 12B:
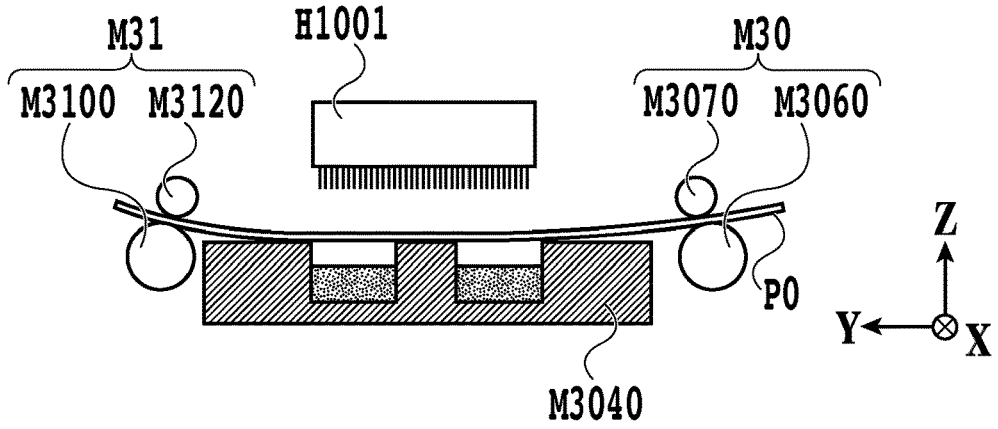
Figure 12C:
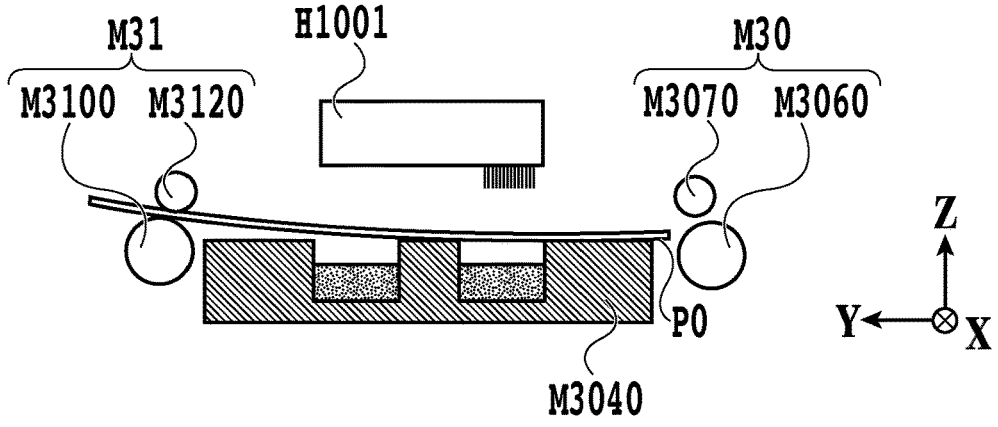

2. Printing Control According to Print Medium Type 2.1 Case of Low-Stiffness Print Medium FIGS. 12A to 12C are diagrams for explaining printing control for a print medium P0 with relatively low stiffness, such as plain paper. A first nip unit M30 serving as a first conveyance member and formed of the conveyance roller M3060 and the pinch rollers M3070 is disposed upstream of the platen M3040 in the conveyance direction (Y direction). Moreover, a second nip unit M31 serving as a second conveyance member is formed of the sheet discharge roller M3100, and the corresponding spur roller M3120 is disposed downstream of the platen M3040 in the conveyance direction. The first nip unit M30 and the second nip unit M31 are located higher than the platen M3040 in the vertical direction. Moreover, the pinch rollers M3070 are disposed slightly downstream of the conveyance roller M3060, and the spur roller M3120 is disposed slightly upstream of the sheet discharge roller M3100. The nozzle surface of the print head H1001 is disposed opposite the platen M3040 and ejects inks to the print medium P0 traveling forward over the platen M3040.

FIG. 12A illustrates a state where the leading edge of the print medium P0 has passed the first nip unit M30 and is before reaching the second nip unit M31. This is a state where the print medium P0 is conveyed only by the first nip unit M30. The leading edge of the print medium P0 having passed the first nip unit M30 contacts the platen M3040 with its own weight and travels forward along the platen M3040 while being supported on the platen M3040. The low-stiffness print medium P0 bends and forms a flat surface along the platen M3040, so that the distance between the print medium P0 and the ejection opening surface of the print head H1001 (head-to-medium distance) is stable. Also, the nipping force of the first nip unit M30 including the conveyance roller M3060, which is a metallic shaft with a surface coated with ceramic micro-particles, and the pinch rollers M3070 is strong, which makes the conveyance accuracy stable as well. Thus, in the present embodiment, 4-pass multipass printing is performed in this state with the entire printing element region, i.e., all 768 nozzles, as the printing-use region. Specifically, a printing scan following the mask patterns illustrated in FIG. 11A and a conveyance operation over 192 nozzles are alternately repeated.

FIG. 12B illustrates a state where the leading edge of the print medium P0 has contacted the sheet discharge roller M3100 and been nipped by the second nip unit M31. In this state too, the low-stiffness print medium P0 forms a flat surface along the platen M3040, so that the head-to-medium distance to the ejection opening surface is stable. Thus, in the present embodiment, in this state too, the 4-pass multipass printing following the mask patterns illustrated in FIG. 11A is performed with all 768 nozzles as the printing-use region.

FIG. 12C illustrates a state where the trailing edge of the print medium P0 is released from the first nip unit M30 and the print medium P0 is conveyed only by the second nip unit M31. In this state too, the low-stiffness print medium P0 forms a flat surface along the platen M3040, so that the head-to-medium distance to the ejection opening surface is stable. However, the nipping force of the second nip unit M31 including the sheet discharge roller M3100, which includes a metallic shaft and a plurality of rubber members provided on it, and the spur roller M3120 is weaker than that of the first nip unit M30, so that the conveyance accuracy is lower than that in the state of FIG. 12A. Thus, in the present embodiment, 4-pass multipass printing is performed in this state with only the 192 nozzles corresponding to ¼ on the upstream side in the conveyance direction as the printing-use region. Specifically, only the 192 nozzles on the upstream side in the conveyance direction are used to alternately repeat a printing scan following the mask patterns illustrated in FIG. 11B and a conveyance operation over 48 nozzles. In this way, although the multipass printing is performed with the same number of passes, i.e., four passes, it possible to keep the conveyance error in a single conveyance action small and thus reduce image impairments originating from the conveyance error. Incidentally, the nozzle region on the upstream side in the conveyance direction, not on the downstream side, is used in the above because using the upstream nozzle region can reduce the number of printing scans to be performed in the state where the nozzle region to be used is shortened and therefore reduce the decrease in throughput.

Figure 13A:
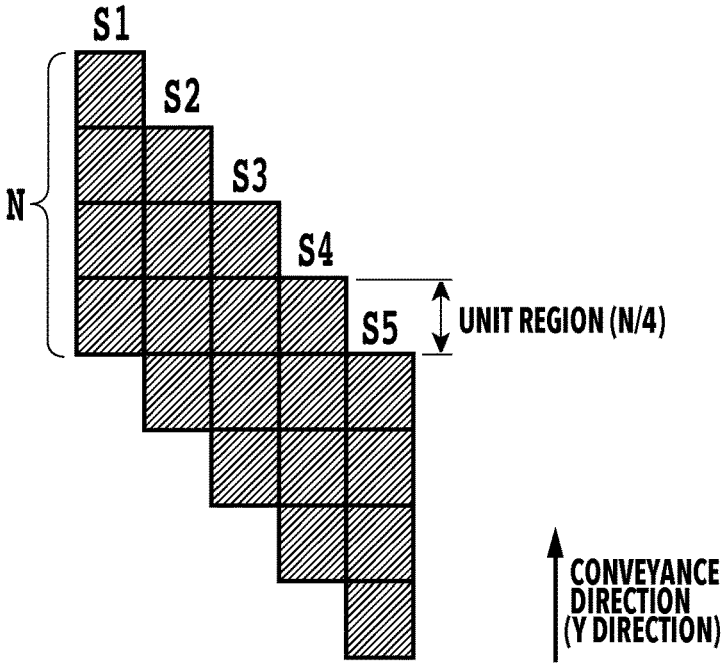
FIGS. 13A and 13B are diagrams illustrating relationships between a printing-use region and the amount of conveyance of the print medium.
Figure 13B:
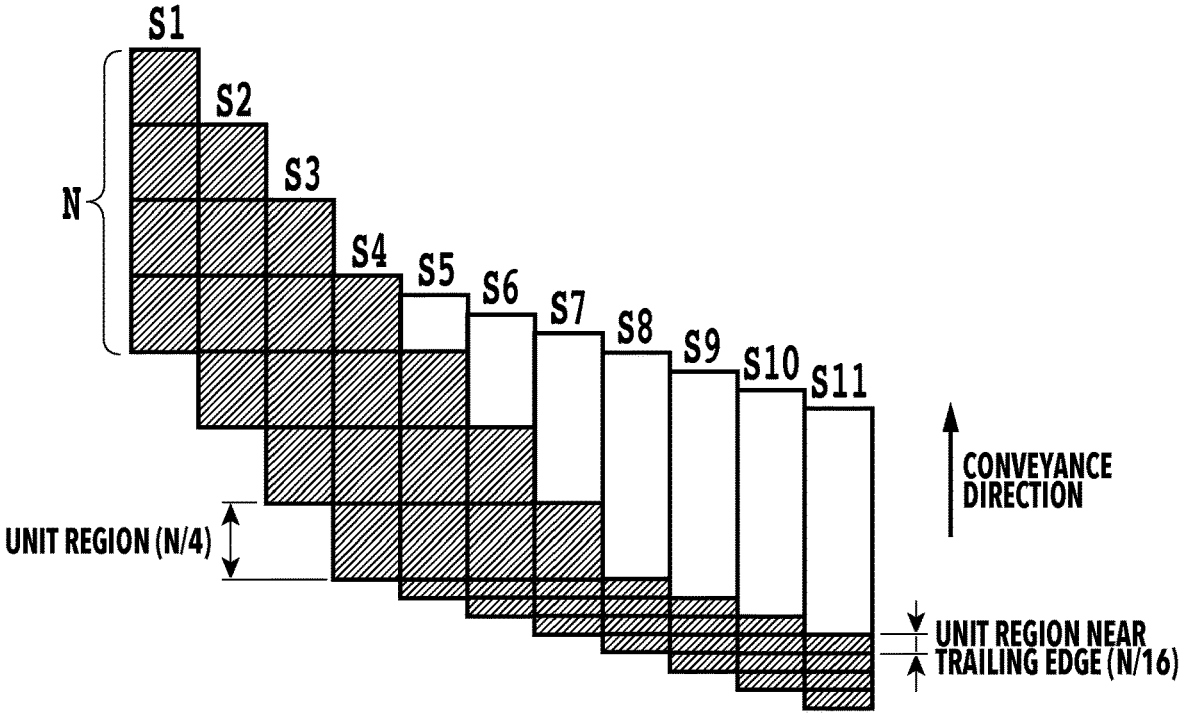

FIGS. 13A and 13B are diagrams illustrating relationships between the printing-use region of the print head H1001 and the amount of conveyance of the print medium P0 in the printing control explained in FIGS. 12A to 12C. FIGS. 13A and 13B illustrate the relationships in such a way that the print head H1001 moves relative to a print medium P1 in the −Y direction. In FIGS. 13A and 13B, the upper side corresponds to the downstream side in the conveyance direction, and the lower side corresponds to the upstream side in the conveyance direction. Moreover, of the nozzle regions arrayed on the print head, each region illustrated by hatched lines represents a printing-use region to be used in the printing and each region illustrated in white represents a region not to be used in the printing.

FIG. 13A illustrates a state of performing the 4-pass multipass printing with the entire region (768 nozzles) as the printing-use region, as in FIGS. 12A and 12B. Each of printing scans S1 to S5 following the mask patterns illustrated in FIG. 11A and a conveyance operation over N/4 (192 nozzles) are alternately performed. An image in each unit region having a width of N/4 is completed by four printing scans of the four nozzle groups.

FIG. 13B illustrates a state of transitioning from the 4-pass multipass printing with the entire region (768 nozzles) as the printing-use region (FIG. 12B) to the 4-pass multipass printing with the upstream N/4 region (192 nozzles) as the printing-use region (FIG. 12C). Printing scans S1 to S4 are each followed by a conveyance operation over N/4 (192 nozzles). A printing scan S5 and subsequent printing scans are each followed by a conveyance operation over N/16 (48 nozzles) while the printing-use region is gradually shortened toward the upstream side. In this example, the width of each unit region near the trailing edge of the print medium is N/4, and an image in the unit region is completed by four printing scans of four nozzle groups each having a width of N/16. By shortening the printing-use region and reducing the amount of conveyance to ¼ as above, the amount of the conveyance error of the second nip unit M31 is also reduced to about ¼. Accordingly, image impairments due to the variation in the amount of conveyance can be made unnoticeable.

2.2 Case of High-Stiffness Print Medium

Figure 14A:
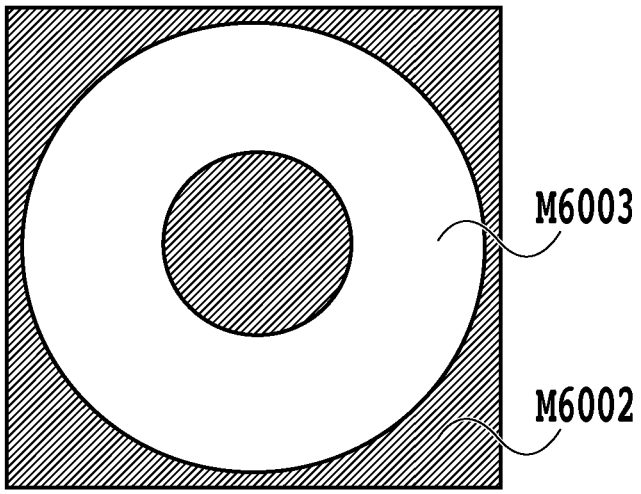
FIGS. 14A and 14B are diagrams illustrating how a print medium or print media are set on a conveyance tray.
Figure 14B:
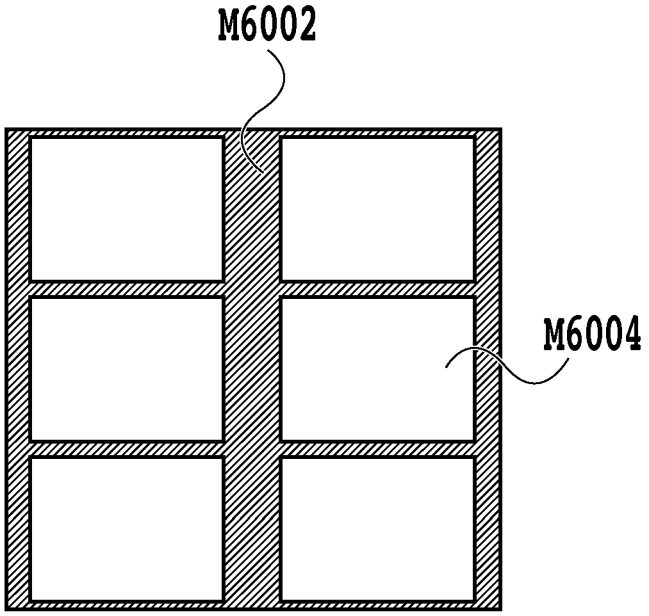

In a case of a print medium with relatively high stiffness, such as board paper, a CD-R, or a card, an image is printed by performing the flat-pass printing explained in FIGS. 3A and 3B. Here, in a case of a print medium with a special shape such as a CD-R or a card, the user sets this printing target medium on a dedicated conveyance tray M6002 and inserts the conveyance tray M6002 into the outlet M3200. FIG. 14A illustrates a state where a circular disc medium such as a CD-R is set on the conveyance tray M6002. FIG. 14B illustrates a state where six small cards are loaded on the conveyance tray M6002. On the other hand, in a case of a print medium having a regular shape such as board paper, the user directly inserts the print medium into the outlet M3200.

FIGS. 15A to 15E are diagrams for explaining a conveyance state in general flat-pass printing. A print medium P1 inserted into the outlet M3200 is conveyed in the −Y direction by the first nip unit M30 and the second nip unit M31, and the trailing edge at the time of the insertion is positioned such that the print head H1001 can perform printing. Thereafter, printing scans of the print head H1001 and conveyance operations in the +Y direction are performed alternately.

Figure 15A:
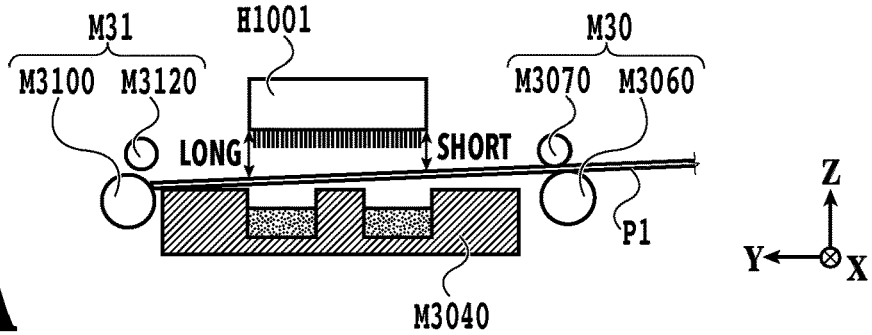
FIGS. 15A to 15E are diagrams for explaining a conventional conveyance state.

FIG. 15A illustrates a state where the leading edge of the print medium P1 has passed the first nip unit M30 and is before reaching the second nip unit M31. The print medium P1 before being nipped by the second nip unit M31 contacts the platen M3040 with its own weight, but does not bend along the platen M3040 like the low-stiffness print medium P0 does. The print medium P1 is therefore in a state of being inclined relative to the ejection opening surface of the print head H1001 such that the head-to-medium distance is short at the upstream side of the print head H1001 and long at the downstream side of the print head H1001.

Figure 15B:
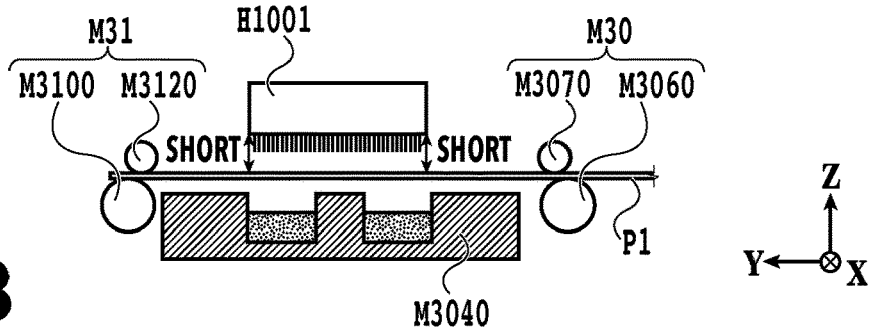

FIG. 15B illustrates a state where the leading edge of the print medium P1 has reached the sheet discharge roller M3100 and been nipped by the second nip unit M31. By being nipped by the second nip unit M31, the leading edge of the print medium P1 is raised, so that the print medium P1 is in a state of being parallel to the ejection opening surface of the print head H1001. This means that the head-to-medium distance at a leading edge portion of the print medium P1 greatly changes from before to after the leading edge is nipped by the second nip unit M31.

Figure 15C:
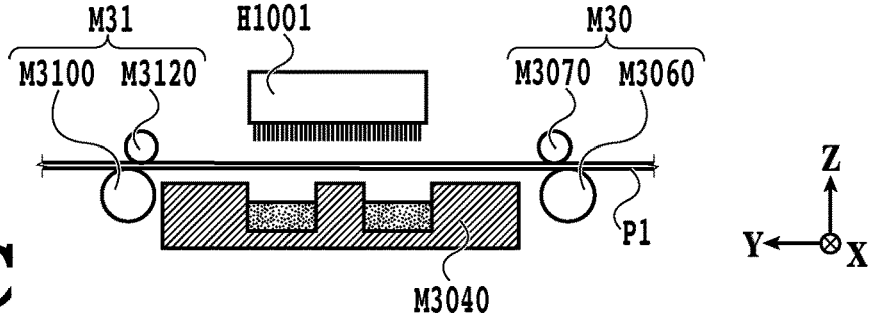

FIG. 15C illustrates a state where an image is being printed onto a center portion of the print medium nipped by the first nip unit M30 and the second nip unit M31. The print medium P1 is held substantially parallel to the ejection opening surface of the print head H1001, thereby keeping a constant head-to-medium distance.

Figure 15D:
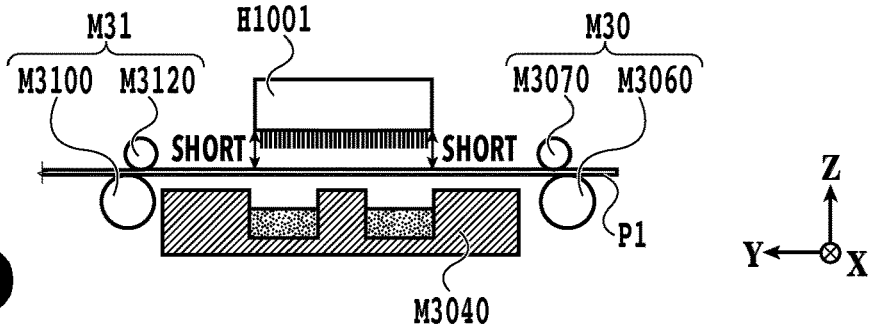

FIG. 15D illustrates a state immediately before the trailing edge of the print medium P1 is released from the first nip unit M30. In this state too, the print medium P1 is held substantially parallel to the ejection opening surface of the print head H1001, thereby keeping a constant head-to-medium distance.

Figure 15E:
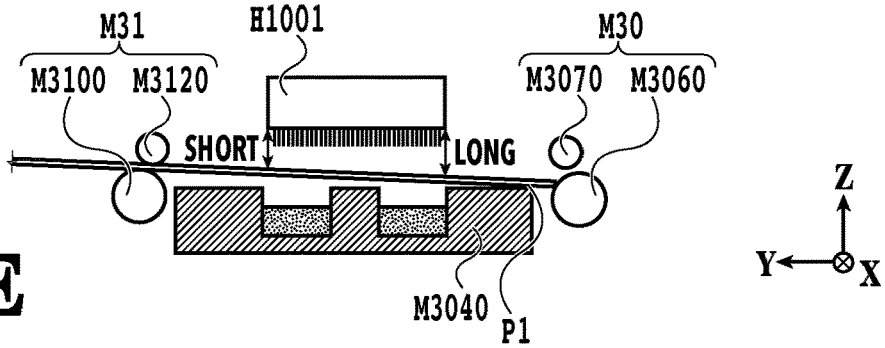

FIG. 15E illustrates a state immediately after the trailing edge of the print medium P1 is released from the first nip unit M30. By being released from the first nip unit M30, the trailing edge of the print medium P1 drops onto the platen M3040. Thus, the print medium P1 is in a state of being inclined relative to the ejection opening surface of the print head H1001. This means that the head-to-medium distance at a trailing edge portion of the print medium P1 greatly changes from before to after the trailing edge is released from the first nip unit M30.

As described above, at the leading edge portion and the trailing edge portion of the high-stiffness print medium P1, the head-to-medium distance changes during the multipass printing, so that the image is printed by printing scans in the state where the head-to-medium distance is long and printing scans in the state where the head-to-medium distance is short. In this case, even if mask patterns having a complementary relationship are used, the dot patterns actually printed on the print medium may fail to have the complementary relationship with each other, thereby impairing the uniformity of the image.

In view of the above, in the present embodiment, in a case of printing a high-stiffness print medium, no printing scan is performed on regions where the head-to-medium distance changes during the multipass printing. Details will be described below.

Figure 17A:
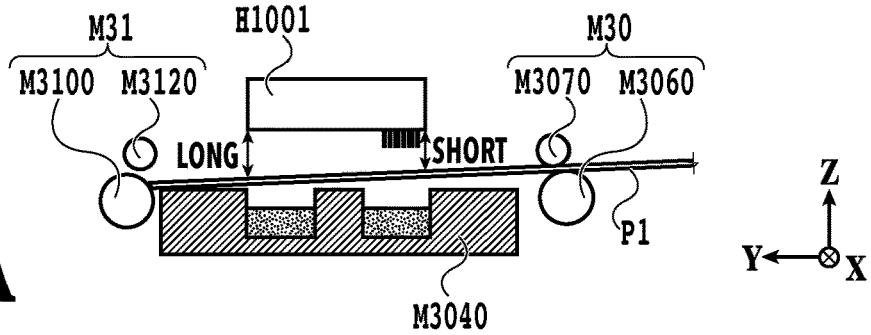
FIGS. 17A to 17E are diagrams for explaining printing control for a high-stiffness print medium.

FIGS. 17A to 17E are diagrams for explaining the printing control for the print medium P1 with relatively high stiffness in the present embodiment. FIG. 17A illustrates a state where the leading edge of the print medium P1 has passed the first nip unit M30 and is before reaching the second nip unit M31. As in FIG. 15A, the print medium P1 is inclined relative to the ejection opening surface of the print head H1001 such that the head-to-medium distance is short at the upstream side of the print head H1001 and long at the downstream side of the print head H1001. At this stage, in the present embodiment, 4-pass multipass printing using only the 192 nozzles on the upstream side of the print head H1001 is performed. Specifically, a printing scan following the mask patterns illustrated in FIG. 11B and a conveyance operation over 48 nozzles are alternately repeated.

Figure 17B:
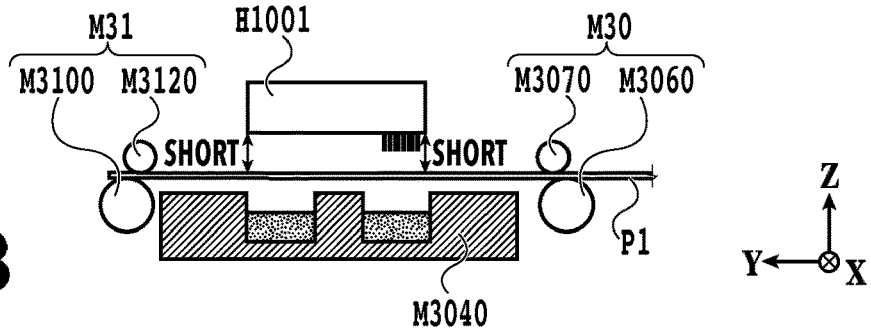

FIG. 17B illustrates a state where the leading edge of the print medium P1 has reached the sheet discharge roller M3100 and been nipped by the second nip unit M31. The print medium P1 is substantially parallel to the ejection opening surface of the print head H1001. At this stage too, in the present embodiment, the 4-pass multipass printing using only the 192 nozzles on the upstream side of the print head H1001 is performed.

During the transition from the state of FIG. 17A to the state of FIG. 17B, the head-to-medium distance changes to a greater extent at the downstream side of the print head than at the upstream side of the print head. For this reason, in the present embodiment, only the upstream side of the print head, at which the change in head-to-medium distance is small, is used as the printing-use region, and the region on the downstream side of the print head, at which the change in head-to-medium distance is large, is not used in the printing. In this way, the effect of the change in head-to-medium distance on the image can be reduced to a low degree.

Figure 17C:
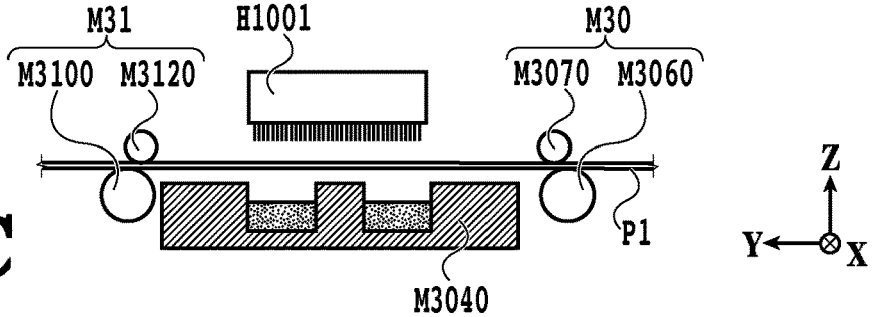

FIG. 17C illustrates a state where an image is being printed onto a center portion of the print medium nipped by the first nip unit M30 and the second nip unit M31. The print medium P1 maintains a substantially parallel orientation to the ejection opening surface of the print head H1001, thereby keeping a constant head-to-medium distance. At this stage, in the present embodiment, 4-pass multipass printing with the entire region (768 nozzles) of the print head H1001 as the printing-use region is performed.

Figure 17D:
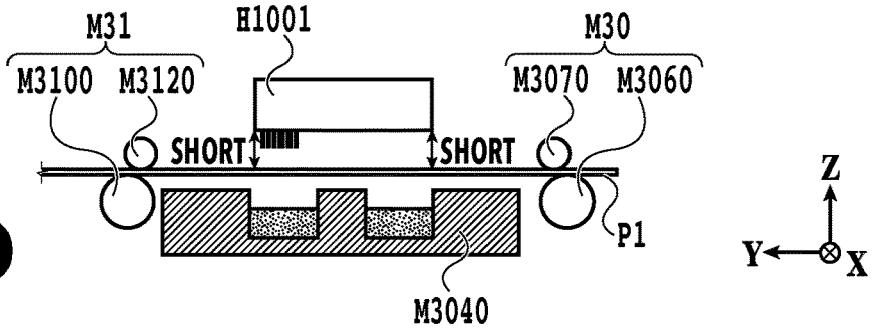
Figure 17E:
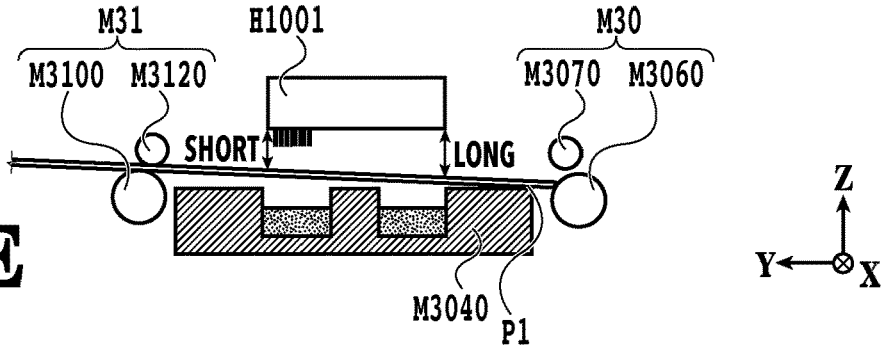

FIG. 17D illustrates a state immediately before the trailing edge of the print medium P1 is released from the first nip unit M30. FIG. 17E illustrates a state immediately after the trailing edge of the print medium P1 is released from the first nip unit M30. At this stage, in the present embodiment, 4-pass multipass printing using only the 192 nozzles on the downstream side of the print head H1001 is performed.

During the transition from the state of FIG. 17D to the state of FIG. 17E, the head-to-medium distance changes to a greater extent at the upstream side of the print head than at the downstream side of the print head. For this reason, in the present embodiment, only the downstream side of the print head, at which the change in head-to-medium distance is small, is used as the printing-use region, and the region on the upstream side of the print head, at which the change in head-to-medium distance is large, is not used in the printing. In this way, the effect of the change in head-to-medium distance on the image can be reduced to a low degree.

At this stage, using the upstream nozzle region as in FIG. 12C explained above may be preferable in view of throughput if only reducing the density unevenness due to the variation of conveyance by the second nip unit M31 is the object. With the high-stiffness print medium P1, however, the change in head-to-medium distance is larger at the upstream nozzle region. Thus, in the present embodiment, only the downstream nozzle region, at which the change in head-to-medium distance is smaller, is the printing-use region. Note that in this case too, the size of the nozzle region to be used and the amount of a single conveyance action are still reduced to a small size and amount. Thus, an advantageous effect of reducing the density unevenness due to the variation of conveyance by the second nip unit M31 can be achieved as in FIG. 12C.

Figure 18A:
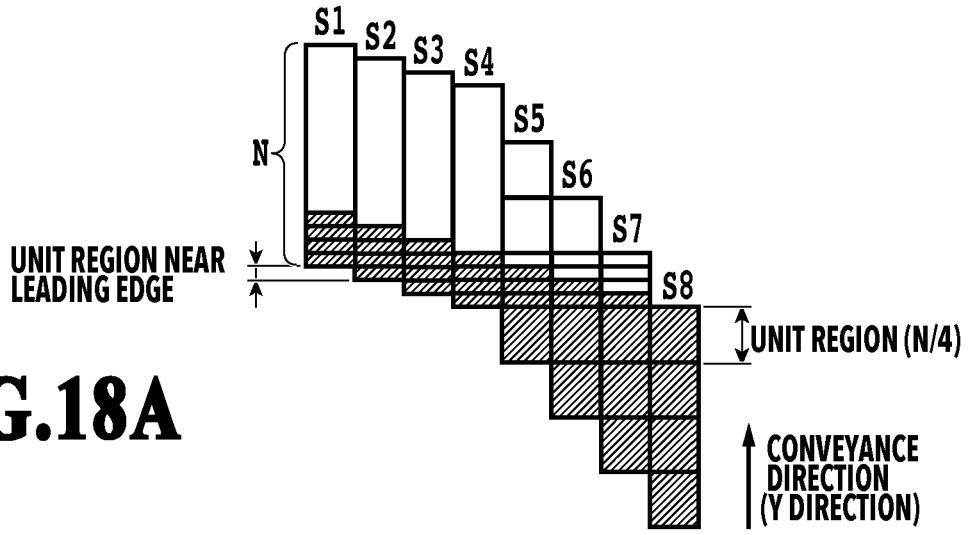
FIGS. 18A to 18C are diagrams illustrating relationships between the printing-use region and the amount of conveyance of the print medium.
Figure 18B:
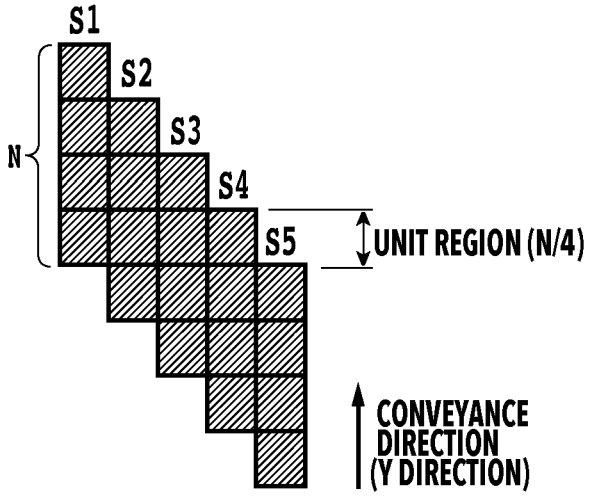
Figure 18C:
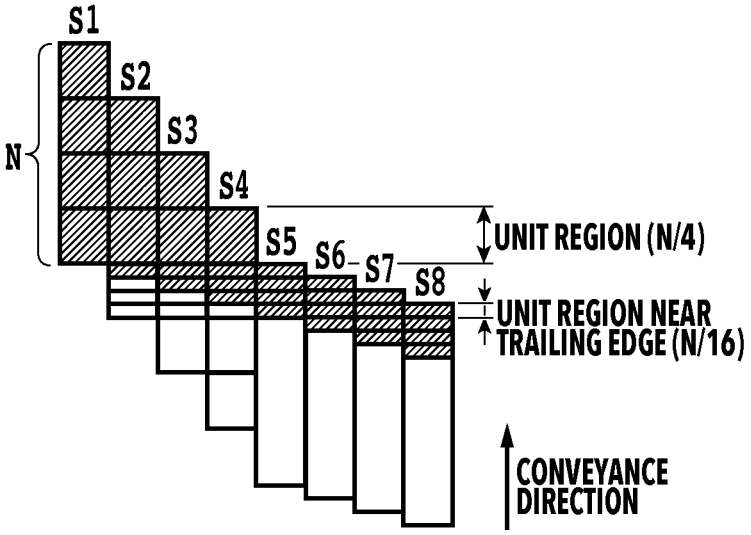

FIGS. 18A to 18C are diagrams illustrating relationships between the printing-use region of the print head H1001 and the amount of conveyance of the print medium P1 in the printing control explained in FIGS. 17A to 17E. FIG. 18A illustrates a state of transitioning from the 4-pass multipass printing with the upstream N/4 region (192 nozzles) as the printing-use region (FIG. 17B) to the 4-pass multipass printing with the entire region (768 nozzles) as the printing-use region (FIG. 17C). In FIG. 18A, each region illustrated by hatched lines represents a printing-use region and each white region represents a region not to be used in the printing. In FIG. 18A, printing scans S1 to S4 are each followed by a conveyance operation over N/16 (48 nozzles). A printing scan S5 and subsequent printing scans are each followed by a conveyance operation over N/4 (192 nozzles) while the printing-use region is gradually extended toward the downstream side.

FIG. 18B corresponds to FIG. 17C and illustrates a state of performing the 4-pass multipass printing with the entire region (768 nozzles) as the printing-use region. Each of printing scans S1 to S5 following the mask patterns illustrated in FIG. 11A and a conveyance operation over N/4 (192 nozzles) are alternately performed. An image in each unit region on the print medium is completed by four printing scans of four nozzle groups having a width of N/4.

FIG. 18C illustrates a state of transitioning from the 4-pass multipass printing with the entire region (768 nozzles) as the printing-use region (FIG. 17C) to the 4-pass multipass printing with the downstream N/4 region (192 nozzles) as the printing-use region (FIG. 17D). In FIG. 18C, the printing scans up to a printing scan S4 are each followed by a conveyance operation over N/4 (192 nozzles) while the printing-use region is gradually shortened toward the downstream side. A printing scan S5 and subsequent printing scans are each followed by a conveyance operation over N/16 (48 nozzles).

Figure 16A:
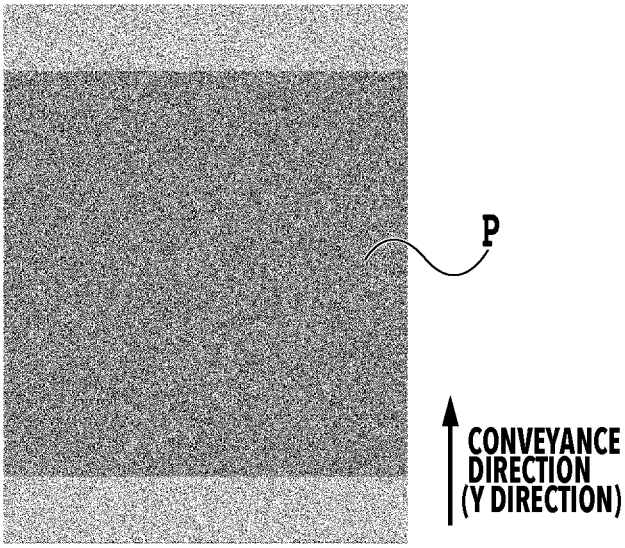
FIGS. 16A and 16B are diagrams comparing printed images.
Figure 16B:
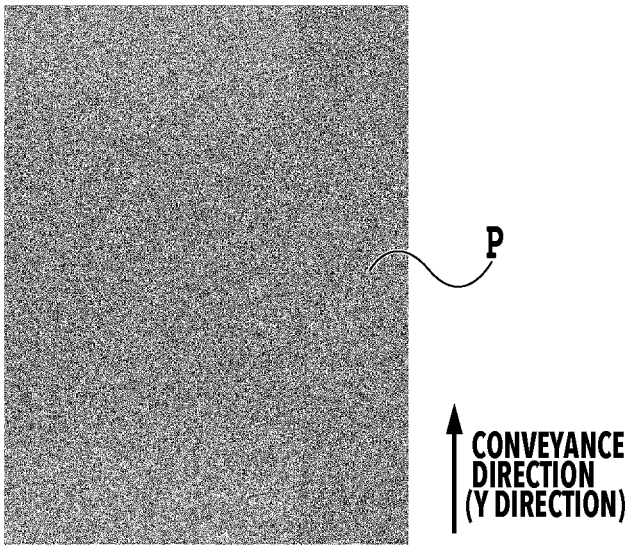

FIGS. 16A and 16B are diagrams comparing an image printed on a high-stiffness print medium by employing the printing method of FIGS. 15A to 15E and an image printed on a high-stiffness print medium by employing the printing method of FIGS. 17A to 17E. In the case of employing the printing method of FIGS. 15A to 15E, in which the entire nozzle region is used as the printing-use region in all printing scans, density unevenness appears at a leading edge portion and a trailing edge portion of the print medium due to the change in head-to-medium distance, and therefore the uniformity of the image is impaired, as illustrated in FIG. 16A. On the other hand, in the case of employing the printing method in the present embodiment illustrated in FIGS. 17A to 17E, density unevenness does not appear at the leading or trailing edge portion of the print medium due to the change in head-to-medium distance, and therefore a uniform image is obtained, as illustrated in FIG. 16B.

As described above, according to the present embodiment, in a case of printing the high-stiffness print medium P1, multipass printing using only nozzles on the upstream side of the print head H1001 is performed around the timing at which the leading edge of the print medium P1 is nipped by the second nip unit M31. On the other hand, multipass printing using only nozzles on the downstream side of the print head H1001 is performed around the timing at which the trailing edge of the print medium P1 is released from the first nip unit M30. Further, multipass printing using all nozzles of the print head H1001 is performed in the state where the print medium P1 is nipped by the first nip unit M30 and the second nip unit M31 and the head-to-medium distance is therefore stable. In this way, it is possible to print a uniform image with no density unevenness on the entire region of the print medium.

Note that the timing at which the leading edge of the print medium P1 is nipped by the second nip unit M31 can be estimated by measuring the amount of rotation of the conveyance roller M3060 from the state where the leading edge of the print medium P1 is positioned in the printing unit. Thus, the printing may only need to be controlled so as to perform the 4-pass multipass printing using the upstream N/4 region (192 nozzles) around this timing and then transition to the 4-pass multipass printing with the entire region (768 nozzles) as the printing-use region.

Also, the timing at which the trailing end of the print medium P1 is released from the first nip unit M30 can be estimated by subtracting a conveyance distance equivalent to the amount of rotation mentioned above from the length of the print medium P1 in the Y direction. Alternatively, this timing can be estimated by measuring the amount of rotation of the conveyance roller M3060 from the point when the PE sensor E0007 detects passage of the trailing edge of the print medium P1. Thus, the printing may only need to be controlled so as to perform the 4-pass multipass printing using the downstream N/4 region (192 nozzles) around this timing.

Second Embodiment

In a second embodiment too, printing control similar to that in the first embodiment is performed using the inkjet printing apparatus described in the first embodiment. In the present embodiment, however, for a high-stiffness print medium, printing control different from that in the first embodiment is performed in a case where the print medium has a predetermined length or longer in the conveyance direction.

Figure 19A:
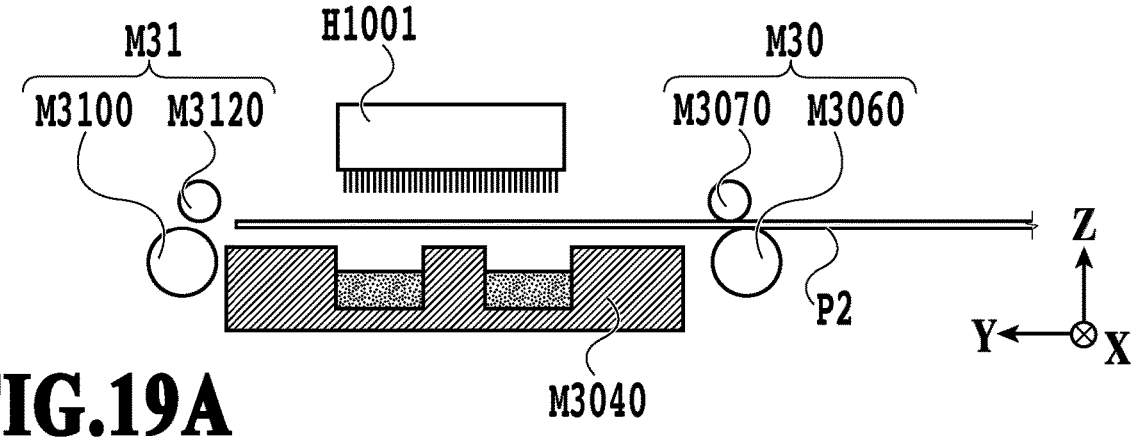
FIGS. 19A to 19C are diagrams for explaining printing control in a second embodiment.
Figure 19B:
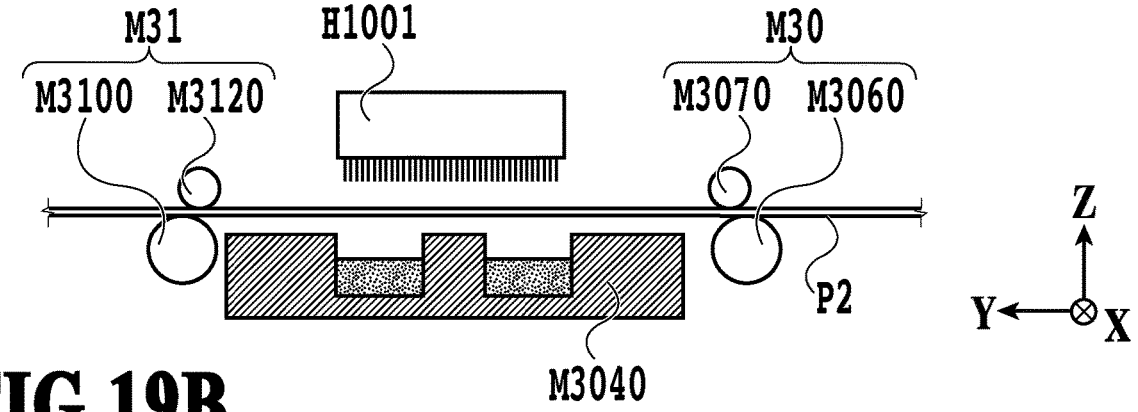
Figure 19C:
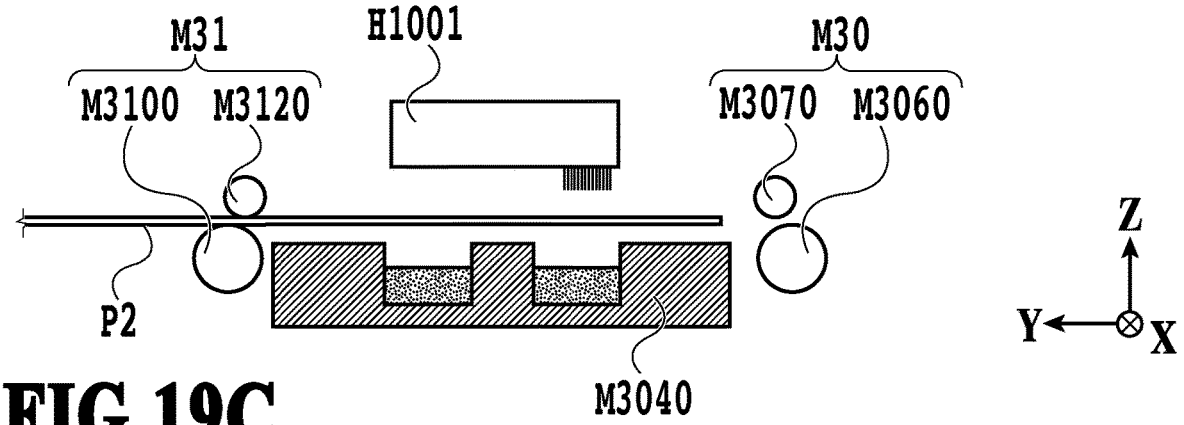

FIGS. 19A to 19C are diagrams for explaining printing control for a print medium P2 having high stiffness and a large size (long in the Y direction). FIG. 19A illustrates a state where the leading edge of the print medium P2 has passed the first nip unit M30 and is immediately before reaching the second nip unit M31. In this state, the gravitational force acting on the portion of the print medium P2 upstream of the first nip unit M30 is greater than the gravitational force acting on the portion downstream of the first nip unit M30. Thus, the print medium P2 is not inclined toward the platen M3040 but is in a state of being substantially parallel to the ejection opening surface of the print head H1001, as illustrated in FIG. 19A. Therefore, in the present embodiment, 4-pass multipass printing with the entire region of the print head H1001 as the printing-use region is performed on the print medium P2 in such a state.

FIG. 19B illustrates a state where an image is being printed onto a center portion of the print medium P2 while being nipped by the first nip unit M30 and the second nip unit M31. The print medium P2 maintains the parallel orientation to the ejection opening surface of the print head H1001, thereby keeping a constant head-to-medium distance. Thus, in the present embodiment, at this stage too, the 4-pass multipass printing with the entire region of the print head H1001 as the printing-use region is performed.

FIG. 19C illustrates a state where the trailing edge of the print medium P2 is released from the first nip unit M30 and the print medium P2 is nipped only by the second nip unit M31. In this state, the gravitational force acting on the portion of the print medium P2 downstream of the second nip unit M31 is greater than the gravitational force acting on the portion upstream of the second nip unit M31. Thus, the print medium P2 is not inclined toward the platen M3040 but is in a state of being substantially parallel to the ejection opening surface of the print head H1001, as illustrated in FIG. 19C.

Here, as already described, the second nip unit M31 cannot achieve as high conveyance accuracy as that of the first nip unit M30. Therefore, in the present embodiment, 4-pass multipass printing with only the ¼ region on the upstream side in the conveyance direction among all 768 nozzles as the printing-use region is performed.

According to the present embodiment as described above, with a high-stiffness print medium, it is possible to output an image at high speed without increasing the printing time more than necessary in a case where the size of the print medium is so large that the change in head-to-medium distance is small.

In the present embodiment, the printing control explained in FIGS. 17A to 17E is performed in the case of a print medium with a size of A4 or smaller, and the printing control explained in FIGS. 19A to 19C is performed in the case of a print medium with a size larger than A4. However, for which print medium sizes the printing control in FIGS. 17A to 17E is to be performed and for which print medium sizes the printing control in FIGS. 19A to 19C is to be performed are not particularly limited. The print medium size for switching from one of the two types of printing control to the other may be set as appropriate according to the configuration of the printing apparatus such as the distance between the first nip unit M30 and the second nip unit M31, or set for each print medium type according to the print medium stiffness.

Incidentally, in the foregoing embodiments, in the case of the low-stiffness print medium P0, multipass printing with the entire region of the print head H1001 as the printing-use region is performed on a leading edge portion of the print medium P0, as explained in FIG. 12A. However, multipass printing with a shortened printing-use region may be performed on the leading edge portion of the print medium in a case where the conveyance accuracy and the head-to-medium distance are unstable also in the state where the print medium P0 is nipped only by the first nip unit M30. In this case, it is preferable to set a downstream portion of the print head H1001 as the printing-use region in view of the stability of the head-to-medium distance and the throughput.

In sum, with inkjet printing apparatuses as described in the foregoing embodiments, the following can be stated. In the case of printing leading and trailing edge portions of a low-stiffness print medium, it is preferable to print the image by setting a region located as far away as possible from the pair of rollers nipping the print medium as the printing-use region, in view of the stability of the head-to-medium distance and the throughput. On the other hand, in the case of printing a leading and trailing edge portions of a high-stiffness print medium, it is preferable to print the image by setting a region located as close as possible to the pair of rollers nipping the print medium as the printing-use region, in view of reducing the image impairments due to the change in head-to-medium distance.

Third Embodiment

In a third embodiment too, printing control similar to those in the first and second embodiments is performed with the inkjet printing apparatus described in the first and second embodiments. Note that, in the present embodiment, for a high-stiffness print medium, printing control different from that in the first embodiment is performed in a case where the margin amount at the leading edge and the trailing edge is large.

Figure 20A:
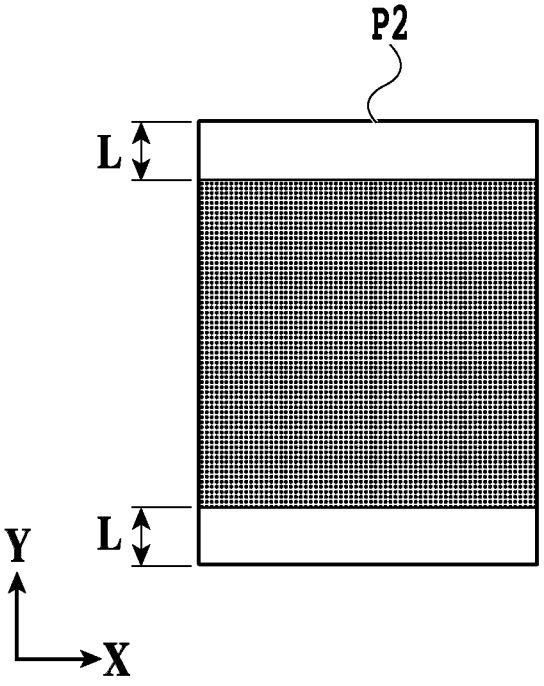
FIGS. 20A and 20B are diagrams illustrating margin amounts on a high-stiffness print medium.
Figure 20B:
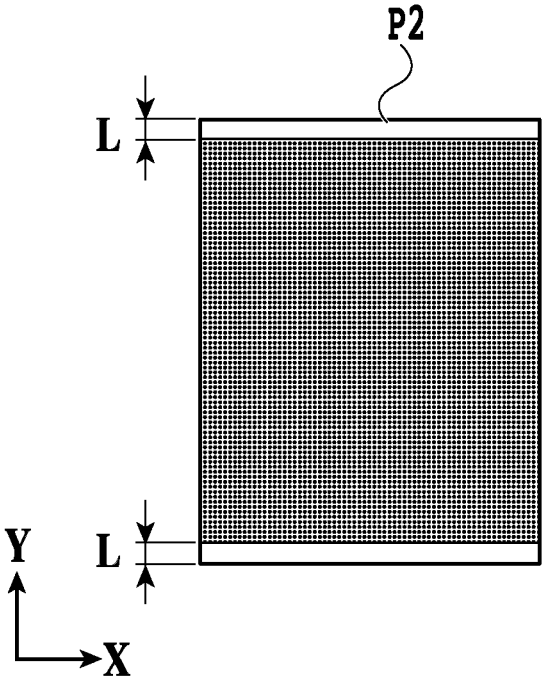
Figure 21A:
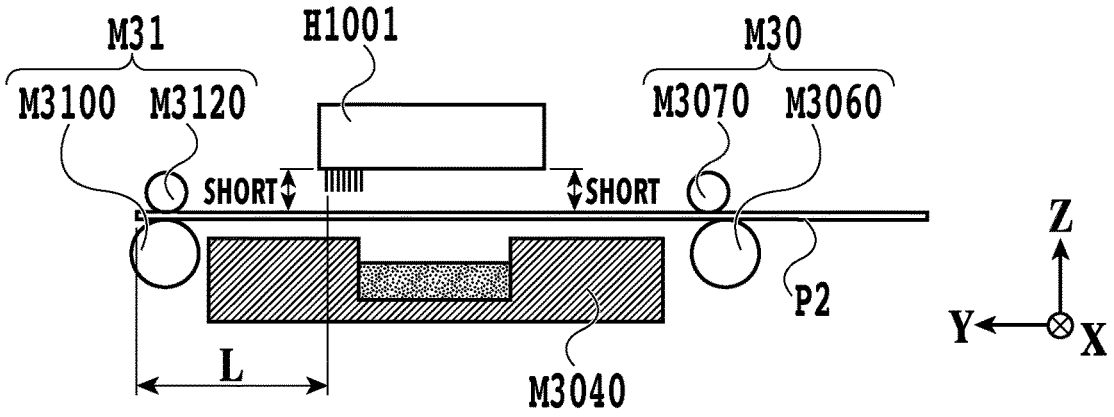
FIGS. 21A to 21C are diagrams for explaining printing control in a third embodiment.
Figure 21B:
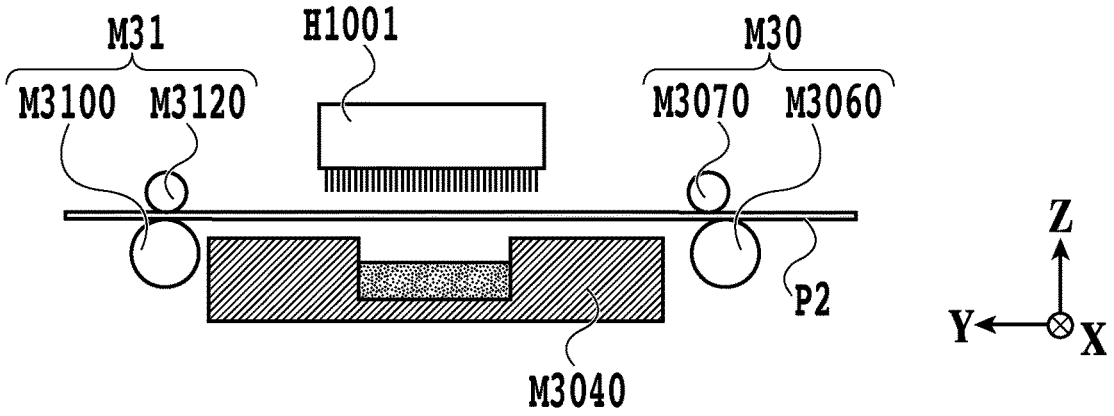
Figure 21C:
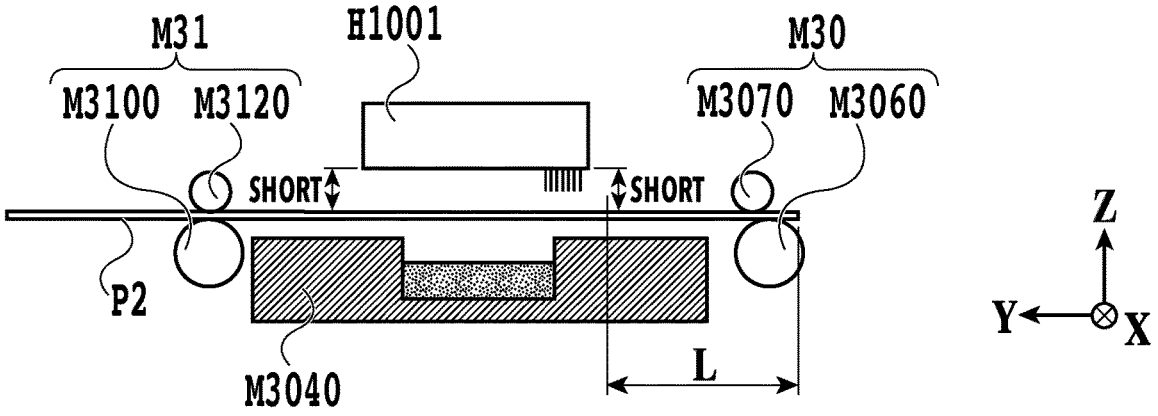

FIGS. 20A and 20B are diagrams illustrating margin amounts on a high-stiffness print medium. FIG. 20A illustrates a case where a margin amount L is greater than a predetermined value, whereas FIG. 20B illustrates a case where the margin amount L is smaller than the predetermined value. In the present embodiment, printing control as illustrated in FIGS. 21A to 21C is performed in the case where the margin amount is greater than the predetermined value as illustrated in FIG. 20A. Note that the predetermined value is 25 mm in the present embodiment. This value corresponds to the distance from the rear end of the print head to the first nip unit M30 and the distance from the front end of the print head to the second nip unit M31. Incidentally, a case where these two distances are equal will be described in the present embodiment, but they may be different values. The distance from the front end of the print head to the second nip unit M31 may be set as the predetermined value for the leading edge, and the distance from the rear end of the print head to the first nip unit M30 may be set as the predetermined value for the trailing edge.

As illustrated in FIG. 21A, in a case where the margin amount L at the leading edge is 25 mm or greater, only the downstream nozzle region is used as the printing-use region. During the printing of the leading edge portion of the print medium P2, the leading edge of the print medium P2 is nipped by the second nip unit M31. The print medium P2 therefore maintains a parallel orientation to the ejection opening surface of the print head H1001, thereby keeping a constant head-to-medium distance.

FIG. 21B illustrates a state where an image is being printed onto a center portion of the print medium P2 while being nipped by the first nip unit M30 and the second nip unit M31. The print medium P2 maintains the parallel orientation to the ejection opening surface of the print head H1001, thereby keeping a constant head-to-medium distance.

As illustrated in FIG. 21C, in a case where the margin amount L at the trailing edge is 25 mm or greater, only the upstream nozzle region is used as the printing-use region. During the printing of the trailing edge portion of the print medium P2, the trailing edge of the print medium P2 is nipped by the first nip unit M30. The print medium P2 therefore maintains the parallel orientation to the ejection opening surface of the print head H1001, thereby keeping a constant head-to-medium distance.

As described above, even in the case of the high-stiffness print medium P2, the leading and trailing edge portions can be printed with the print medium nipped if the margin amount L at the leading and trailing edge portions is greater than the predetermined value.

Figure 22A:
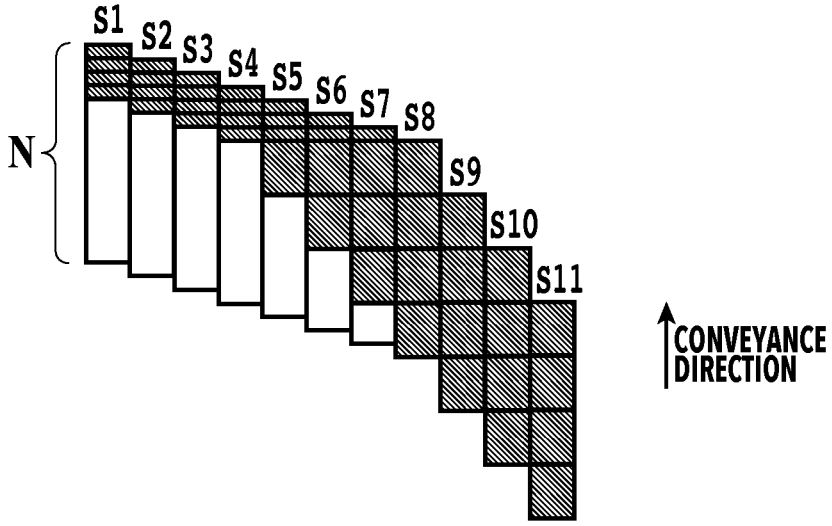
FIGS. 22A to 22C are diagrams illustrating relationships between the printing-use region and the amount of conveyance of the print medium in a third embodiment.
Figure 22B:
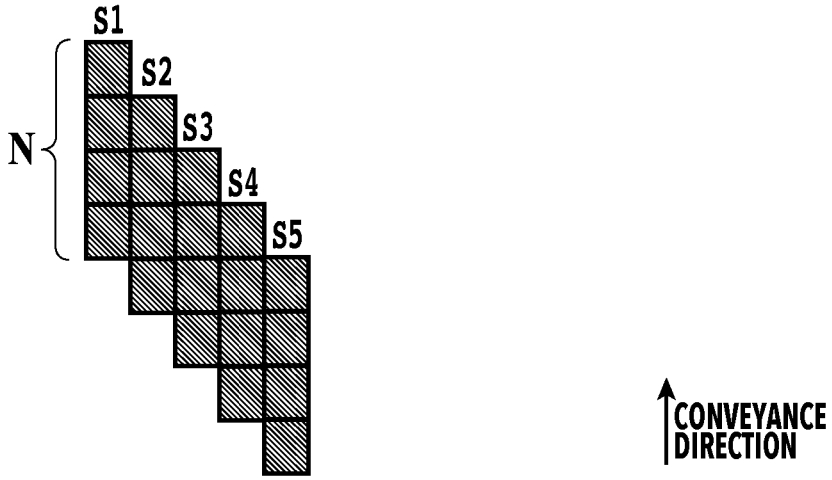
Figure 22C:
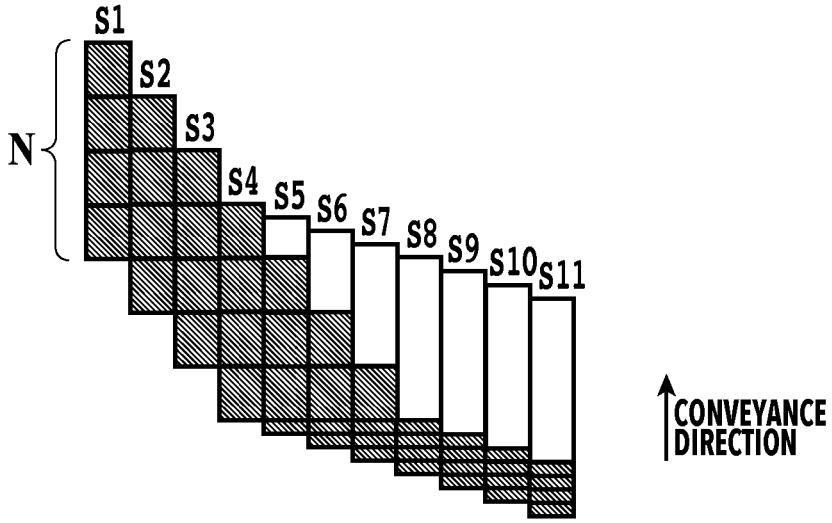

FIGS. 22A to 22C are diagrams illustrating relationships between the printing-use region of the print head H1001 and the amount of conveyance of the print medium P2 in the printing control described using in FIGS. 21A to 21C. FIG. 22A illustrates a state of transitioning from the 4-pass multipass printing with the downstream N/4 region (192 nozzles) as the printing-use region in FIG. 21A to the 4-pass multipass printing with the entire region (768 nozzles) as the printing-use region in FIG. 21B. In FIG. 22A, each region illustrated by hatched lines represents a printing-use region and each white region represents a region not to be used in the printing. Printing scans S1 to S8 are each followed by a conveyance operation over N/16 (48 nozzles). A printing scan S9 and subsequent scans are each followed by a conveyance operation over N/4 (192 nozzles). Also, for the printing scan S5 and subsequent scans, the printing-use region is gradually extended toward the upstream side.

FIG. 22B illustrates a state of performing the 4-pass multipass printing with the entire region (768 nozzles) as the printing-use region in FIG. 21B. Between printing scans S1 to S5 following the mask patterns illustrated in FIG. 11A, a conveyance operation over N/4 (192 nozzles) is performed. As a result, an image in each unit region on the print medium is completed by four printing scans of four nozzle groups each having a width of N/4.

FIG. 22C illustrates a state of transitioning from the 4-pass multipass printing with the entire region (768 nozzles) as the printing-use region in FIG. 21B to the 4-pass multipass printing with the upstream N/4 region (192 nozzles) in FIG. 21C. Printing scans S5 to S7 are each followed by a conveyance operation over N/16 (48 nozzles) while the printing-use region is gradually shortened toward the upstream side.

As described above, even in the case of the high-stiffness print medium P2, it is possible to perform printing with both edges nipped if the margin amount L at the leading and trailing edge portions is greater than the predetermined value. On the other hand, if the margin amount L at the leading and trailing edge portions is smaller than the predetermined value, it is possible to print the image while reducing the density unevenness due to the change in head-to-medium distance by implementing the printing method in the first embodiment described above.

Note that in the present embodiment, the user sets the margin amount by selecting the sheet size as a setting in printing. In the present embodiment, for example, A4 "large margin" can be selected as a sheet size besides A4. In a case where A4 "large margin" is selected, the control in the present embodiment is implemented. Here, the margin amount may be determined by comparing the size of the print image data and the sheet size in the sheet setting.

The number of nozzles arrayed on the print head, the number of passes in the multipass printing, the size of the printing-use region, and so on described in the foregoing embodiments are an example, and they may be changed as appropriate. For example, it is preferable that the size of the printing-use region for printing leading and trailing edge portions of a print medium be adjusted as appropriate according to the distance between the conveyance roller and the sheet discharge roller, the distance between the platen and the ejection opening surface, the type and size of the print medium, the printing resolution, the number of passes in the multipass printing, the printing quality, and so on. Also, the printing-use region for printing leading and trailing edge portions of a print medium does not necessarily have to include the most upstream and downstream nozzles of the print head. A region at a certain distance from the most upstream side or the most downstream side may be used as the printing-use region as long as the change in head-to-medium distance caused by to the presence and absence of a nip does not have an effect on the region.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-031662 filed Feb. 27, 2020, which is hereby incorporated by reference herein in its entirety.

What is claimed is:

1. A printing apparatus comprising:

a conveyance unit including a first conveyance member that conveys a print medium in a conveyance direction and a second conveyance member that is disposed downstream of the first conveyance member in the conveyance direction and conveys the print medium in the conveyance direction;

a printing unit located between the first conveyance member and the second conveyance member in the conveyance direction and having a printing element array being a plurality of printing elements that are arrayed in the conveyance direction and apply a print material onto the print medium conveyed by the conveyance unit; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a first state in which the print medium of the first type is supported by the first conveyance member and not supported by the second conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

2. The printing apparatus according to claim 1, wherein the control unit controls the printing unit such that, in a case where an image is to be printed onto the print medium of the first type in a second state in which the print medium of the first type is supported by the second conveyance member and not supported by the first conveyance member, the printing unit uses the printing element included in the second region and does not use the printing element included in the first region.

3. The printing apparatus according to claim 1, wherein the control unit controls the printing unit such that, in a case where an image is to be printed onto the print medium of the first type in a state in which the print medium of the first type is supported by both the first conveyance member and the second conveyance member, the printing unit prints the image by using the printing elements included in an entirety of the printing element region.

4. The printing apparatus according to claim 1, further comprising a platen disposed between the first conveyance member and the second conveyance member in the conveyance direction and supporting the print medium from below.

5. The printing apparatus according to claim 4, wherein the first conveyance member is disposed to be higher than the platen in the height direction.

6. The printing apparatus according to claim 4, wherein the second conveyance member is disposed to be higher than the platen in the height direction.

7. The printing apparatus according to claim 1, wherein the print medium of the first type is board paper.

8. The printing apparatus according to claim 1, wherein the print medium of the first type is a conveyance tray with a printing target medium set thereon.

9. The printing apparatus according to claim 1, wherein the first conveyance member and the second conveyance member convey the print medium by nipping the print medium.

10. The printing apparatus according to claim 9, wherein nipping force of the second conveyance member is weaker than nipping force of the first conveyance member, and the control unit controls the printing unit such that, in a case where an image is to be printed onto a print medium of a second type having lower stiffness than the print medium of the first type in a state in which the print medium of the second type is supported by the second conveyance member and not supported by the first conveyance member, the printing unit uses the printing element included in the first region and does not use the printing element included in the second region.

11. The printing apparatus according to claim 1, wherein the control unit controls the printing unit such that in a case where an image is to be printed onto a print medium of a third type having a larger size in the conveyance direction than the print medium of the first type in a state in which the print medium of the third type is supported by the first conveyance member and not supported by the second conveyance member, the printing unit prints the image by using the printing elements included in an entirety of the printing element region, and in a case where an image is to be printed onto the print medium of the third type in a state in which the print medium of the third type is supported by the second conveyance member and not supported by the first conveyance member, the printing unit uses the printing element included in the first region and does not use the printing element included in the second region.

12. The printing apparatus according to claim 1, wherein the control unit controls the conveyance unit such that the conveyance unit conveys the print medium in the conveyance direction by a distance shorter than a width of a region in the printing element region to be used in the printing scan.

13. The printing apparatus according to claim 1, wherein the printing elements are inkjet printing elements that eject an ink.

14. A printing apparatus comprising:

a conveyance unit including a first conveyance member that conveys a print medium in a conveyance direction and a second conveyance member that is disposed downstream of the first conveyance member in the conveyance direction and conveys the print medium in the conveyance direction;

a printing unit located between the first conveyance member and the second conveyance member in the conveyance direction and having a printing element array being a plurality of printing elements that are arrayed in the conveyance direction and apply a print material onto the print medium conveyed by the conveyance unit;

an obtaining unit that obtains information indicating a type of the print medium; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where the information obtained by the obtaining unit indicates board paper and an image is to be printed onto the print medium in a state where the print medium is supported by the first conveyance member and not supported by the second conveyance member, the printing unit uses a printing element included in a first region and does not use a printing element included in a second region located downstream of the first region in the conveyance direction.

15. A printing apparatus comprising:

a conveyance unit including a first conveyance member that conveys a print medium in a conveyance direction and a second conveyance member that is disposed downstream of the first conveyance member in the conveyance direction and conveys the print medium in the conveyance direction;

a printing unit located between the first conveyance member and the second conveyance member in the conveyance direction and having a printing element array being a plurality of printing elements that are arrayed in the conveyance direction and apply a print material onto the print medium conveyed by the conveyance unit;

a platen disposed between the first conveyance member and the second conveyance member in the conveyance direction at a position lower than the first conveyance member in a height direction perpendicular to a surface where the printing elements are arrayed, and supporting the print medium from below; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a state in which the print medium of the first type is supported by the first conveyance member and not supported by the second conveyance member, the printing unit uses a printing element included in a first region and does not use a printing element included in a second region located downstream of the first region in the conveyance direction.

16. A printing apparatus comprising:

a conveyance unit including a first conveyance member that conveys a print medium in a conveyance direction and a second conveyance member that is disposed downstream of the first conveyance member in the conveyance direction and conveys the print medium in the conveyance direction;

a printing unit located between the first conveyance member and the second conveyance member in the conveyance direction and having a printing element array being a plurality of printing elements that are arrayed in the conveyance direction and apply a print material onto the print medium conveyed by the conveyance unit; and a control unit that controls the conveyance unit and the printing unit so as to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the control unit controls the printing unit such that, in a case where an image is to be printed onto a print medium of a first type in a state in which the print medium of the first type is supported by the second conveyance member and not supported by the first conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

17. A control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a first state in which the print medium of the first type is supported by the first conveyance member and not supported by the second conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

18. The control method according to claim 17, wherein the printing unit is controlled such that, in a case where an image is to be printed onto the print medium of the first type in a second state in which the print medium of the first type is supported by the second conveyance member and not supported by the first conveyance member, the printing unit uses the printing element included in the second region and does not use the printing element included in the first region.

19. The control method according to claim 17, wherein the printing unit is controlled such that, in a case where an image is to be printed onto the print medium of the first type in a state in which the print medium of the first type is supported by both the first conveyance member and the second conveyance member, the printing unit prints the image by using the printing elements included in an entirety of the printing element region.

20. The control method according to claim 17, wherein the printing apparatus further includes a platen disposed between the first conveyance member and the second conveyance member in the conveyance direction and supporting the print medium from below.

21. The control method according to claim 17, wherein the first conveyance member and the second conveyance member convey the print medium by nipping the print medium.

22. The control method according to claim 21, wherein nipping force of the second conveyance member is weaker than nipping force of the first conveyance member, and the printing unit is controlled such that, in a case where an image is to be printed onto a print medium of a second type having lower stiffness than the print medium of the first type in a state in which the print medium of the second type is supported by the second conveyance member and not supported by the first conveyance member, the printing unit uses the printing element included in the first region and does not use the printing element included in the second region.

23. The control method according to claim 17, wherein the printing unit is controlled such that in a case where an image is to be printed onto a print medium of a third type having a larger size in the conveyance direction than the print medium of the first type in a state in which the print medium of the third type is supported by the first conveyance member and not supported by the second conveyance member, the printing unit prints the image by using the printing elements included in an entirety of the printing element region, and in a case where an image is to be printed onto the print medium of the third type in a state in which the print medium of the third type is supported by the second conveyance member and not supported by the first conveyance member, the printing unit uses the printing element included in the first region and does not use the printing element included in the second region.

24. The control method according to claim 17, wherein the conveyance unit is controlled to convey the print medium in the conveyance direction by a distance shorter than a width of a region in the printing element region to be used in the printing scan.

25. A control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, a printing unit located between the first conveyance member and the second conveyance member in the conveyance direction and having a printing element array being a plurality of printing elements that are arrayed in the conveyance direction and apply a print material onto the print medium conveyed by the conveyance unit, and an obtaining unit that obtains information indicating a type of the print medium to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where the information obtained by the obtaining unit indicates board paper and an image is to be printed onto the print medium in a state where the print medium is supported by the first conveyance member and not supported by the second conveyance member, the printing unit uses a printing element included in a first region and does not use a printing element included in a second region located downstream of the first region in the conveyance direction.

26. A control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, a platen disposed between the first conveyance member and the second conveyance member in the conveyance direction at a position lower than the first conveyance member in a height direction, and supporting the print medium from below, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a state in which the print medium of the first type is supported by the first conveyance member and not supported by the second conveyance member, the printing unit uses a printing element included in a first region and does not use a printing element included in a second region located downstream of the first region in the conveyance direction.

27. A control method that uses a printing apparatus including a conveyance unit including a first conveyance member that conveys a print medium in a conveyance direction and a second conveyance member that is disposed downstream of the first conveyance member in the conveyance direction and conveys the print medium in the conveyance direction, and a printing unit located between the first conveyance member and the second conveyance member in the conveyance direction and having a printing element array being a plurality of printing elements that are arrayed in the conveyance direction and apply a print material onto the print medium conveyed by the conveyance unit to print an image onto the print medium by performing a printing scan in which the printing unit is caused to apply the print material while being scanned in a direction crossing the conveyance direction, and a conveyance operation in which the conveyance unit is caused to convey the print medium in the conveyance direction, wherein the printing unit is controlled such that, in a case where an image is to be printed onto a print medium of a first type in a state in which the print medium of the first type is supported by the second conveyance member and not supported by the first conveyance member, the printing unit uses a printing element included in a first region from which a distance to the print medium of the first type in a height direction perpendicular to a surface where the printing elements are arrayed is a first distance, and does not use a printing element included in a second region from which a distance to the print medium of the first type in the height direction is a second distance greater than the first distance.

* * * * *